US005632324A

United States Patent [19]

Nara et al.

[11] Patent Number: 5,632,324

[45] Date of Patent: May 27, 1997

[54] METHOD OF CONTINUOUSLY CASTING STEELS

[75] Inventors: Seiko Nara; Akira Idogawa; Nagayasu Bessho; Tetsuya Fujii, all of Chiba, Japan

[73] Assignee: Kawasaki Steel Corporation, Japan

[21] Appl. No.: 602,782

[22] PCT Filed: Jul. 14, 1995

[86] PCT No.: PCT/JP95/01405

§ 371 Date: Mar. 7, 1996

§ 102(e) Date: Mar. 7, 1996

[87] PCT Pub. No.: WO96/02342

PCT Pub. Date: Feb. 1, 1996

[30] Foreign Application Priority Data

Jul. 14, 1994 [JP] Japan ..... 6-162103
Jul. 11, 1995 [JP] Japan ..... 7-174894

[51] Int. Cl.[6] ..... B22D 17/02; B22D 11/00

[52] U.S. Cl. ..... 164/466; 164/502

[58] Field of Search ..... 164/466, 502, 164/468

[56] References Cited

U.S. PATENT DOCUMENTS 3,911,997 10/1975 Sugazawa et al. ..... 164/468
5,265,665 11/1993 Fujii et al. ..... 164/466

*Primary Examiner*—Kuang Y. Lin
*Attorney, Agent, or Firm*—Austin R. Miller

[57] ABSTRACT

When molten steel jetted through an immersion nozzle into a mold for continuous casting is controlled by applying static field between opposed side walls of the mold for the continuous casting, this invention provides cast slabs having good surface and internal qualities by feeding molten steel to the mold for the continuous casting at a throughput of not less than 6 t/min and simultaneously applying a static field having a magnetic flux density of at least 0.5 T to a meniscus portion in the mold for the continuous casting and a static field having a magnetic flux density of not less than 0.5 T to a lower portion of molten steel jetted out from a discharge port of the immersion nozzle.

8 Claims, 31 Drawing Sheets

Index of molten steel temperature in mold: Tt−Tm
Tundish temperature Tt
Molten steel surface in mold Tm FIG 2a
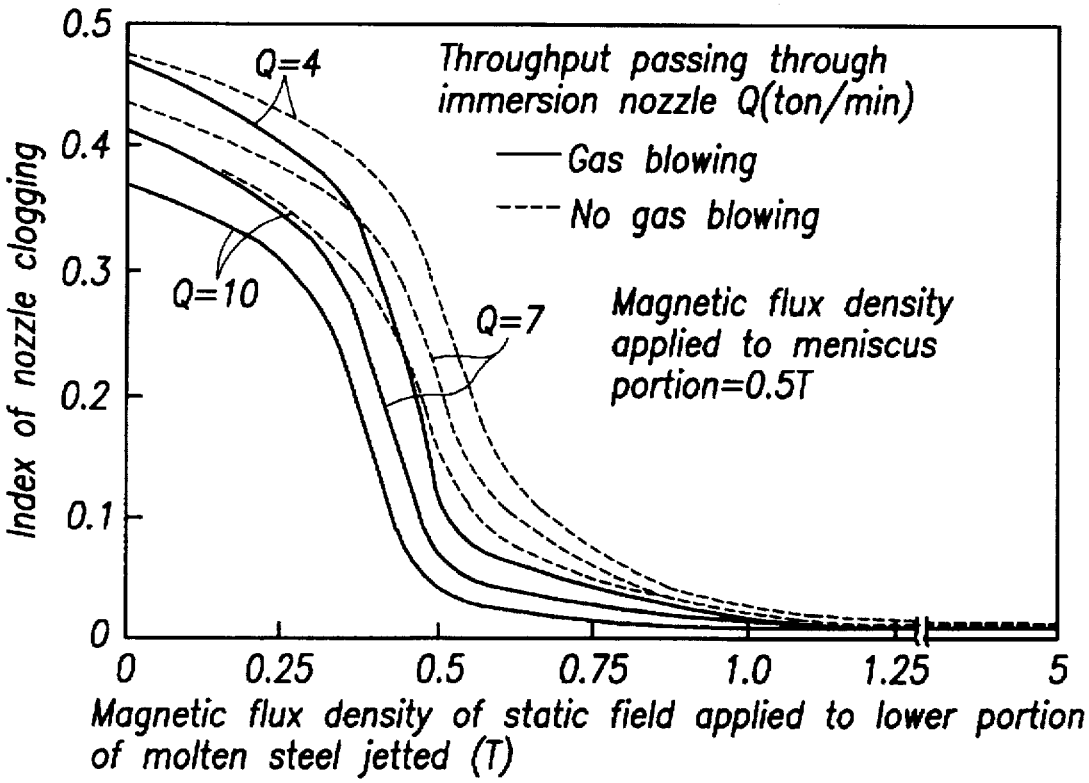
* 6 continuous casting
* Index of nozzle clogging:(Sb−Sa)/Sb
Sb area of discharge port in nozzle before casting
Sa area of discharge port in nozzle after casting
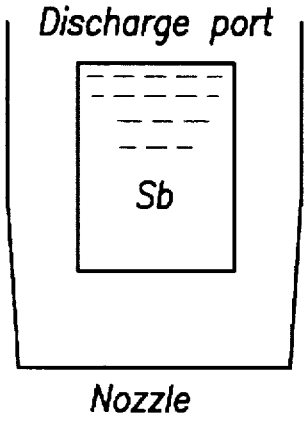
FIG 2b
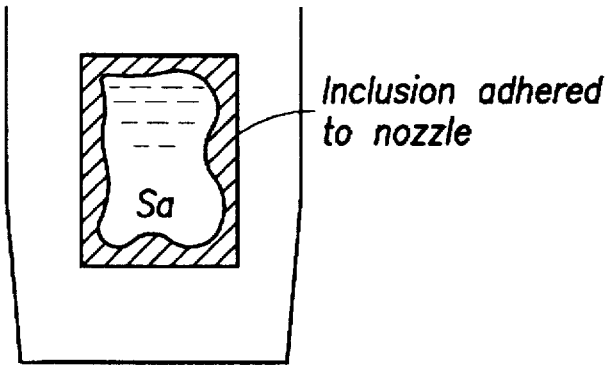
FIG 2c Occurrence ratio of coil defect (%): Dp/N x 100
Total coil number N
Defect occurring ratio Dp Occurrence ratio of breakout (%) : Nb/N x 100
Total casting charge number N
Casting charge generating breakout Nb FIG 5a
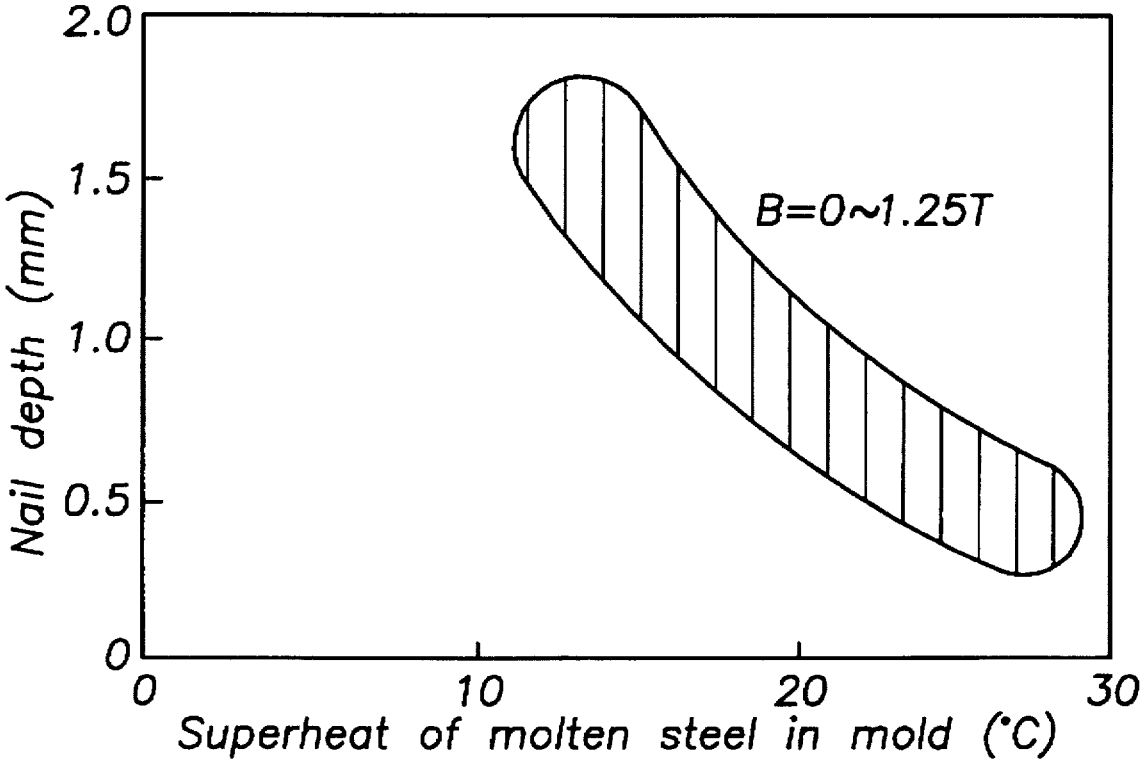
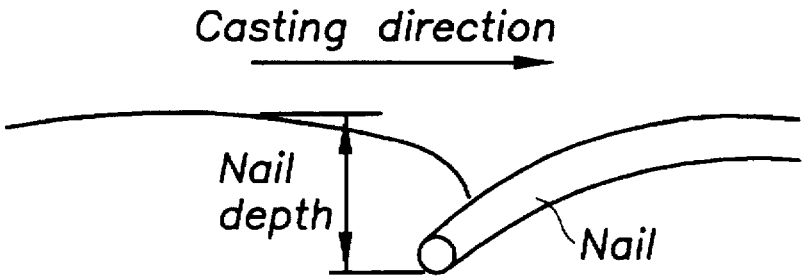
FIG 5b

METHOD OF CONTINUOUSLY CASTING STEELS

TECHNICAL FIELD

In the continuous casting of steel, molten steel received in a tundish is fed to a continuously casting mold through an immersion nozzle formed in a bottom of the tundish. In this case, the flow rate of molten steel jetted out from a discharge port of the immersion nozzle is considerably large as compared with the casting rate of steel, so that inclusions or bubbles in molten steel are apt to be deeply penetrated into a crater and hence it is not avoided to cause internal defects. Further, there is a problem of remelting solidification shell, while the jet of molten steel in an upstream flowing direction (contrarotating flow or the like) among the jets of molten steel upheaves a meniscus portion in the mold to promote variation of molten steel surface to thereby entrap mold powder thereinto, which has a remarkably bad influence upon the quality of the resulting cast slab and the casting operation.

This invention stably provides cast slabs having improved surface and internal qualities by mitigating variations in the molten steel surface in a mold for continuous casting, entrapment of powder, entrapment of inclusions and the like to improve the internal quality and sounding surface properties when molten steel is cast at a higher throughput exceeding two times of the conventional throughput for molten steel and a higher speed.

BACKGROUND ART

In order to control the flow of molten steel jetted out from the immersion nozzle, it was usual to contrive the shape of the discharge port in the immersion nozzle, or to decrease the pouring rate of molten steel.

However, it was difficult to completely prevent quality defects resulting from inclusion or the like in molten steel by simply changing the shape of the discharge port or decreasing the pouring rate of molten steel.

As a prior art relating to this point, JP-A-57-17356 discloses a method of applying a braking force to the flow of molten steel jetted out from the immersion nozzle by arranging a device for generating a static field in the mold for the continuous casting, and JP-A-2-284750 discloses a technique of applying a braking force to the flow of molten steel jetted out from the immersion nozzle by Lorenz force produced through an interaction between current and magnetic field induced by applying a static field to the entire mold for the continuous casting.

In the technique disclosed in JP-A-57-17356, when the braking force is applied to the jet of molten steel, the flowing direction is changed to disperse the energy inherent to the jet of molten steel as if the jet of molten steel collides with a wall and hence the uniform flow can not be obtained. Further, the jet of molten steel escapes in a direction having no static field, so that the satisfactory result can not be obtained.

In the technique disclosed in JP-A-2-284750, it is possible to attain the uniformization of molten steel jetted out from the immersion nozzle and the variation of molten steel surface on the meniscus portion can be made small, so that the surface and internal qualities of the cast slab can be improved to a certain extent, respectively. However, when the high-speed casting is carried out under a condition that the throughput of molten steel exceeds 2 times of the conventional throughput, there still remaining the following problems.

1) When using a multihole type immersion nozzle, the occurrence of deflected flow in a mold accompanied with the flow of molten steel jetted out from the immersion nozzle can not be avoided.
2) In case of the multihole type immersion nozzle, when the clogging of the nozzle is caused with the increase of the flow rate of molten steel jetted, the deflected flow in the mold becomes large and hence the continuous casting can not stably be attained.
3) In case of the multihole type immersion nozzle, the contrarotating flow at a short side of the mold becomes high speed accompanied with the increase of the flow rate of molten steel jetted, so that the variation of molten steel surface becomes large and the entrapment of powder can not be avoided. Moreover, the use of single-hole type immersion nozzle can be considered. In the latter case, when the static field is applied to a lower zone of molten steel jetted, the contrarotating upstream of molten steel is generated through an influence of reflection current (induction current flowing in a direction of promoting the jet of molten steel) in the mold to cause the variation of molten steel surface and hence powder is entrapped.
4) Since the disorder of molten steel becomes large during the oscillation of the mold, the depth of oscillation mark becomes deeper and also the oscillation mark becomes disordered, so that surface defects (coil defect) are frequently created in the resulting rolled steel sheet.
5) Since the molten steel surface is rippled inside the mold to disorder the oscillation mark, it is difficult to uniformly supply powder and hence it is apt to cause restraint breakout due to the occurrence of sticking or the like.
6) There is a fear of remelting solidification shell by the flow of molten steel jetted out from the immersion nozzle.

Recently, there is proposed a continuously casting method through the application of static field to a lower end portion of a mold for the continuous casting (JP-A-7-51801, JP-A-7-51802, JP-A-59-76647, JP-A-62-254955, Iron Steel Eng., May (1984), pp 41–47, JP-A-6-126399), a continuous casting method using two nozzles while applying the static field to the lower end of the mold for the continuous casting (JP-A-5-277641) and the like.

These techniques are intended for not only the continuous casting of ordinary steel but also the casting of clad steel. In these techniques, it is possible to decrease the flow rate by applying the static field to an adequate zone (zone near to solidification shell at a side of short-side wall in the mold for the continuous casting or the like) for the flow of molten steel jetted out from the immersion nozzle, so that these techniques may sufficiently be applied to the continuous casting of ordinary steel. In any case, the value of the static field is not more than 0.5 T, so that it can not be adapted to the high-speed casting at a throughput of 6–10 t/min. Therefore, it is a disadvantage that the castable quantity is very slight without generating defects in the product.

In order to increase magnetic flux density and mitigate power cost, JP-B-63-54470 discloses a technique of exchanging the conventional normal conducting electromagnet with a superconducting electromagnet.

However, when the conditions of applying the static field are bad irrespectively of the normal conducting electromagnet or the superconducting electromagnet, there are rather frequently generated defects. Particularly, when the high-speed casting is carried out by changing the throughput of molten steel from about 5 t/min usually used to more than 6 t/min, the restrictions in the operation become severer from problems such as disorder of molten steel surface, entrapment of inclusions and the like. In this technique, there is no description on magnetic field applying conditions and casting conditions required for obtaining cast slabs having no defect.

In this connection, a casting method using a superconducting electromagnet and a cuspid magnetic field is disclosed in JP-A-3-94959. According to this method, the intensity of the magnetic field is about 0.15 T at most and is fairly small as compared with the case of using the conventional electromagnet and also the application system of the magnetic field is cusp, so that it is impossible to control the variation of molten steel surface in the mold for the continuous casting questioned in the high-speed casting.

Moreover, a method of casting slabs having less defects by applying a static field having a magnetic field intensity of 0.5 T at maximum to a lower end of the mold is disclosed in JP-A-4-52057, whereby it is possible to mitigate the entrapment of bubbles and inclusions as compared with the conventional case. However, the casting conditions are the same as in the conventional technique, so that it can not cope with the high-speed casting.

Up to the present, there is no proposal for solving the above items 1)–6) in order to realize the high-throughput, high-speed casting.

It is an object of the invention to solve the aforementioned problems when the high-speed casting is carried out at a high throughput and to provide a novel method of continuously casting steel to produce carefree cast slabs suitable for DHCR process (direct hot charged rolling process) or CC-DR process (continuous casting rolling process) as well as an apparatus suitable for carrying out this method.

DISCLOSURE OF INVENTION

This invention is a method of continuously casting steel by controlling a jet of molten steel fed through an immersion nozzle into a mold for continuous casting while applying a static field between opposed side walls of the mold for the continuous casting, characterized in that molten steel is fed into the mold for the continuous casting at a throughput of not less than 6 t/min, and that an air-core superconducting electromagnet is used to simultaneously apply a static field having a magnetic flux density of at least 0.5 T to a meniscus portion in the mold for the continuous casting and a static field having a magnetic flux density of not less than 0.5 T to a lower portion of molten steel jetted out from a discharge port of the immersion nozzle.

In the invention, the static field is applied to a full region in widthwise direction of the mold including the meniscus portion and the lower portion of molten steel jetted.

Further, the continuous casting is carried out by oscillating the mold for the continuous casting so as to satisfy $S \cdot F \geqq 450$ (S: up and down strokes (mm) of the mold for the continuous casting, F: oscillation number (cpm)) in the feeding of molten steel through the immersion nozzle.

A gas (gases such as Ar, $N_2$, $NH_3$, $H_2$, He, Ne and the like are used alone or in admixture) is blown into the immersion nozzle according to a condition of $0.5Q \geqq f \geqq 20+3Q$ (f: gas blowing amount (Nl/min), Q: throughput of molten steel (t/min)).

As the immersion nozzle is used a single-hole type straight nozzle.

In the invention, when the air-core super-conducting electromagnet is used as an electromagnet applying the static field, support members are separately arranged in the mold for the continuous casting and the superconducting electromagnet, and a distance between magnetic poles of the superconducting electromagnet is changed so as to approach with each other or separate away from each other in accordance with casting conditions to adjust the magnetic flux density of the static field.

It is particularly advantageous that current is applied to the mold for the continuous casting, and that an induction current generated by the application of the static field is taken out from a short-side wall of the mold for the continuous casting and supplied to the other short-side wall thereof to circulate the induction current.

BRIEF DESCRIPTION OF THE DRAWINGS

FIG. 2 is a graph showing a relation between a nozzle clogging and a magnetic flux density (i.e. magnetic flux density when static field is applied to a lower portion of molten steel jetted).

FIGS. 2*b* and 2*c* schematically show discharge ports of a nozzle, without and with inclusions, respectively.

FIG. 5 is a graph showing a relation between a nail depth in oscillation mark portion and a superheat of molten steel.

FIG. 5*b* shows a portion of a nail-like shell on the surface of a steel sheet.

BEST MODE FOR CARRYING OUT THE INVENTION

Figure 1A:
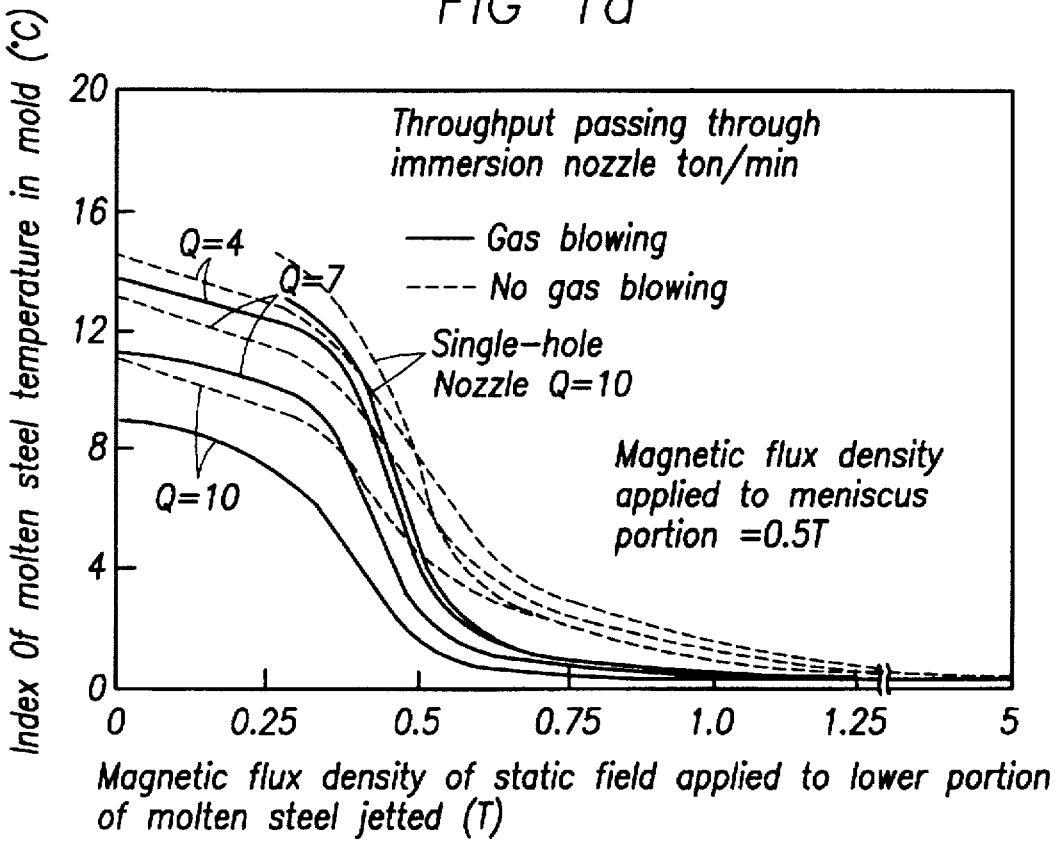
FIG. 1*a* is a graph showing the relation between the temperature of molten steel surface in a mold for continuous casting and a magnetic flux density (i.e. magnetic flux density when static field is applied to a lower portion of molten steel jetted).
Figure 1B:
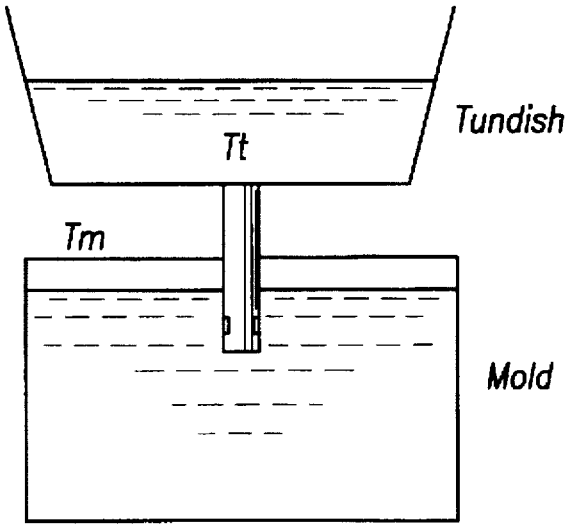
FIG. 1*b* schematically shows a tundish and a mold and their accompanying labels $T_t$ and $T_m$ for the tundish temperature and molten steel surface in the mold.
Figure 8A:
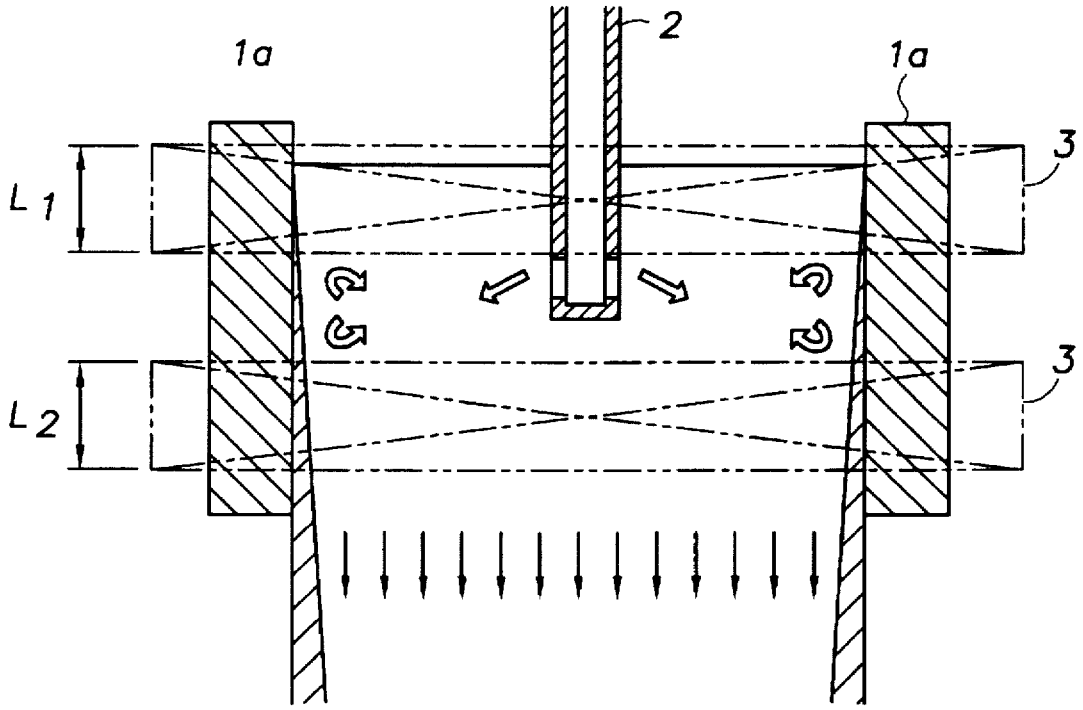
FIGS. 8*a* and *b* are diagrammatic views illustrating the construction of the other equipment suitable for carrying out the invention.
Figure 8B:
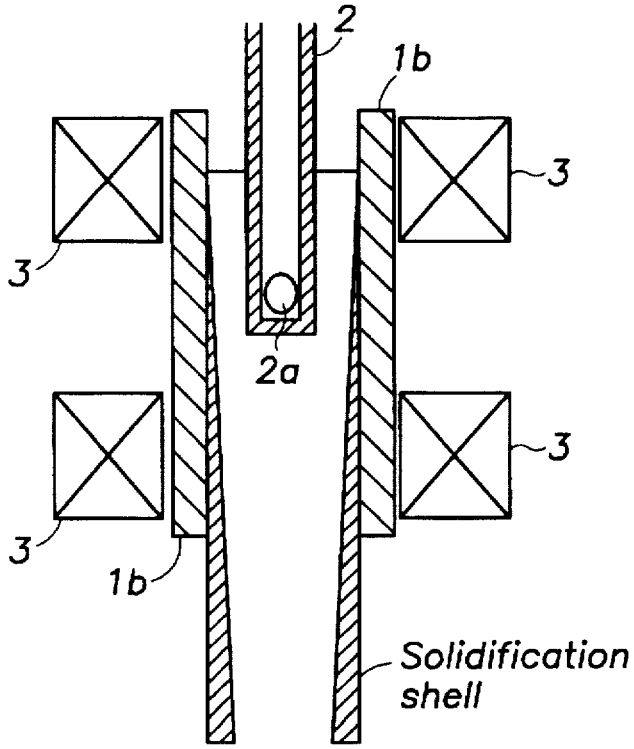

FIGS. 1*a*, 1*b* and FIGS. 2*a*, 2*b* and 2*c* show results examined on relations of a temperature of molten steel surface in a mold (index) and a nozzle clogging in an immersion nozzle (index) to a magnetic flux density of static field applied in the continuous casting (application type of magnetic field: full width type of two up-and-down stage $L_1$=250 mm, $L_2$=250 mm, see FIG. 8, magnetic flux density: applicable of 0–10 T) when the continuous casting is carried out under conditions that an amount Q or throughput of molten steel fed through the immersion nozzle (C: 20–30 ppm, Mn: 0.1–0.2 wt %, P: 0.01–0.012 wt %, S: 0.006–0.010 wt %, Ai: 0.032–0.045 wt %, T.O: 22–32 ppm) is 4 t/min, 7 t/min, or 10 t/min, a temperature of molten steel in a tundish $T_f$: 1555°–1560° C., 1 charge: 230 t, a size of a mold: 260 mm×1300 mm, a vertical bending type continuous casting machine (vertical portion: 3 m), an immersion nozzle: two-hole nozzle, a nozzle size: 70 mm in inner diameter, a size of a discharge port: square of 70 mm×80 mm, a nozzle angle: 15° downward, and presence or absence of blowing a gas (Ar gas) for the prevention of nozzle clogging, respectively. Moreover, the magnetic flux density in FIGS. 1*a* and 2*a* is adjusted to 0.5 T in a meniscus portion and a range of 0–5 T in a lower portion of molten steel jetted. As a gas blowing amount, stroke and oscillation condition, FIG. 1*a* is gas blowing amount: 20±2 Nl/min, stroke of mold: 8–10 mm and oscillation: 187–257 cpm, and FIG. 2*a* is gas blowing amount: 22±4 Nl/min, stroke of mold: 7–9 mm and oscillation: 170–220 cpm.

When the jet of molten steel is controlled by applying a static field in such a manner that the magnetic flux density is 0.5 T in the meniscus portion and 0.5 T in the lower portion of the molten steel jet, the lowering of the temperature of molten steel surface in the mold becomes small (FIG. 1), and the nozzle clogging is reduced by rectifying action of the molten steel jet at the discharge port of the nozzle (FIG. 2).

Particularly, the above tendency becomes remarkable in case of blowing the gas. Even if the gas blowing is not carried out, the effect arises at 0.5 T and becomes conspicuous near to 0.7 T. Near to 1.0 T, the effect approaches to the case of blowing the gas, and hence the lowering of the molten steel surface temperature is small and the nozzle clogging is substantially eliminated. Since the gas is blown into molten steel as bubbles, the floating effect is first developed by blowing at a flow rate of not less than 0.5Q Nl/min (Q: throughput). When a great amount of the gas is blown, the floating effect becomes large and the control of the molten steel jet is easy, but as the amount of bubbles per unit volume becomes too large, current produced in the magnetic field hardly passes and the braking effect of the magnetic field drops down. Therefore, when the gas is blown into the immersion nozzle, the throughput of molten steel as Q (t/min) is about 20+3Q as an upper limit.

When the static field is applied so as to have a magnetic flux density of about 0.5–1.0 T, it is particularly preferable that the gas is blown at $0.5Q \leqq f \leqq 20+3Q$ (f: gas blowing amount (Nl/min)).

In the gas blowing, the lower limit is determined from the floating of inclusions and the degree of requesting the temperature rise of molten steel surface, while the upper limit is determined from a point of preventing the entrapment of inclusions transferred with the jet under the application of the magnetic field through solidification shell or a point of preventing the increase of inclusions due to disorder of molten steel surface.

As a gas to be blown, Ar gas is acceptable usual, but a mixed gas of Ar and $N_2$ may be used. In addition, various gases capable of producing the floating effect through bubbles and giving the braking force to the jet of molten steel and causing no contamination of molten steel may be used, so that the kind of the gas is not particularly restricted.

As to the static field applied to control the jet of molten steel, it is important that the magnetic flux density is not simply increased but the length of the magnetic field applied to the jet of molten steel is maintained in a particular range.

The application length of magnetic field capable of controlling the jet of molten steel is considered to be a range capable of giving a braking force for stopping or decelerating kinetic energy of flowing molten steel. In general, energy E of magnetic filed applied to the flowing conductive fluid can be represented by $E \propto (V_1/\rho)B^2 \cdot L$ when an average flow velocity of the fluid is $V_1$, a magnetic flux density is B, a resistivity of the conductive fluid is ρ and an application length of magnetic field is L (see FIGS. 6–8). In case of the high-speed casting at a throughput of molten steel of not less than 6 t/min, the application length L of the magnetic field required for decreasing the flow velocity of molten steel can particularly be represented as $k \cdot Q/B \leqq L$ (k:0.55, L(cm), B (T), Q (t/min)) by determining a constant of proportionality from model experiments and the like.

In the invention, it is favorable that the minimum value of the length of magnetic filed applied to the meniscus portion is about 50 mm and also the minimum value of the length of magnetic field applied to the lower portion of the molten steel jet is about 50 mm.

When the static field is applied by using an air-core superconducting electromagnet, the application length L of magnetic field is a distance between upper and lower ends of winding in the electromagnet, and the magnetic flux density B is maximum at ½ of a thickness of a casting mold in the application length L of the magnetic field. Therefore, when a plurality of electromagnets for the application of magnetic field are used, L is $L=L_1+L_2 \ldots +L_n$.

When static field is applied to a mold for continuous casting in such a manner that the magnetic flux density in the meniscus portion is not less than 0.5 T and at the same time the magnetic flux density in the lower portion of the molten steel jet is not less than 0.5 T, the variation of molten steel surface due to the contrarotating flow of molten steel in case of using the multihole type immersion nozzle is suppressed, and also the downstream of molten steel discharged and downstreamed from the immersion nozzle is rectified, so that the flowing of molten steel in the nozzle and the discharge port thereof becomes uniform and hence a fear of nozzle clogging is less.

In the case of the single-hole type immersion nozzle, when static field of not less than 0.5 T is simultaneously applied to the meniscus portion and the lower portion of the molten steel jet, the variation of molten steel surface due to the contrarotating upstream of molten steel is suppressed and also the collision of the molten steel jet with solidification shell, which is concerned due to the high-throughput, high-speed casting, is avoided and hence a risk of remelting is considerably mitigated.

Figure 3:
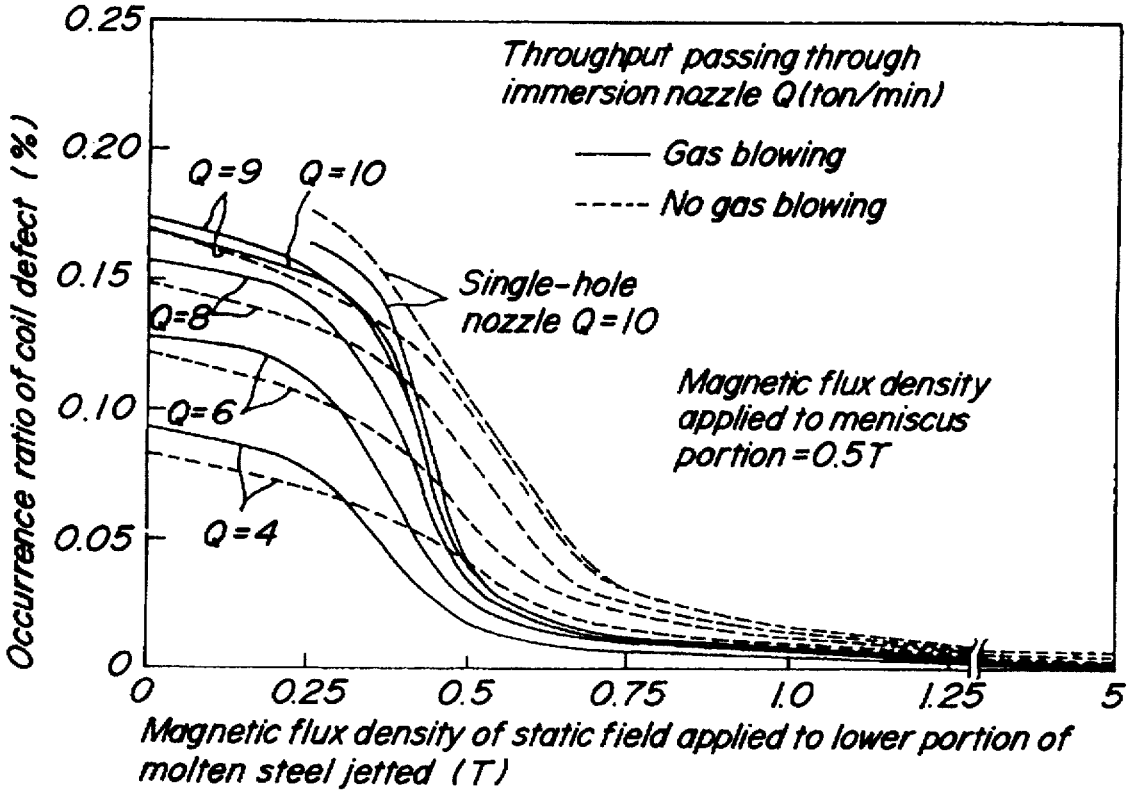
FIG. 3 is a graph showing a relation between an occurrence ratio of coil defect and a magnetic flux density (i.e. magnetic flux density when static field is applied to a lower portion of molten steel jetted).
Figure 4:
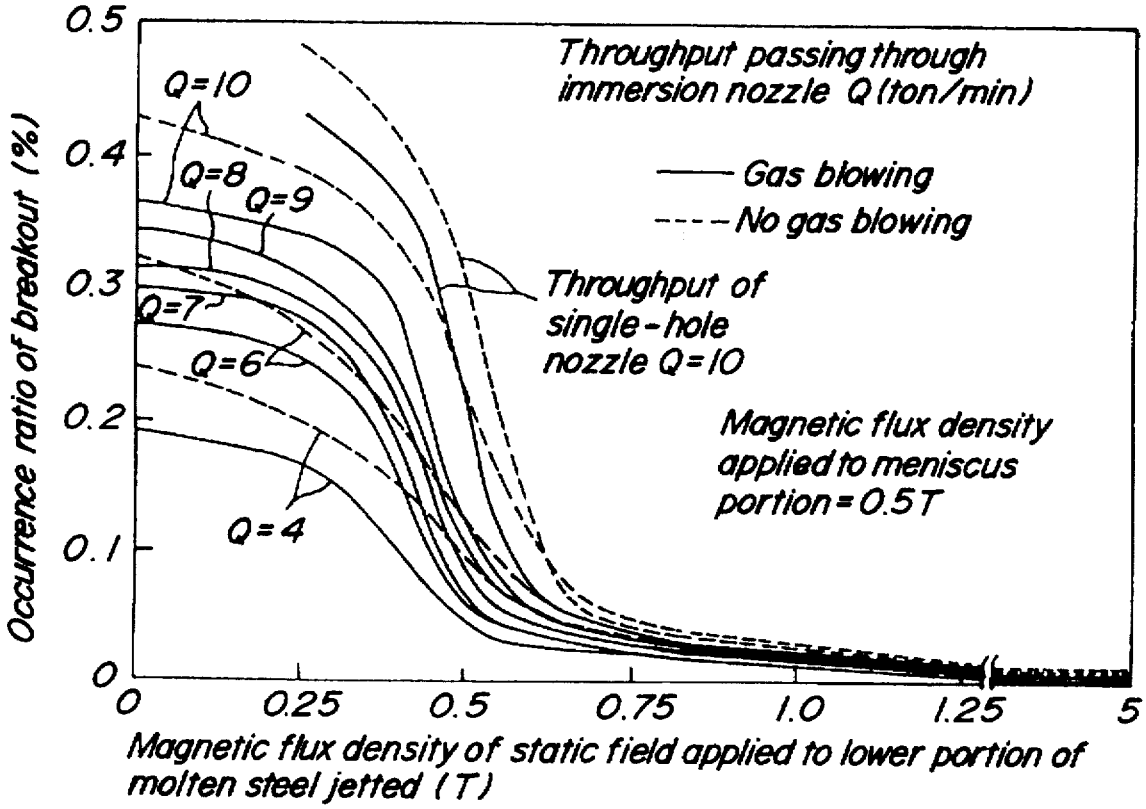
FIG. 4 is a graph showing a relation between an occurrence ratio of breakout and a magnetic flux density (i.e. magnetic flux density when static field is applied to a lower portion of molten steel jetted).

FIG. 3 and FIG. 4 show results of tests evaluating the occurrence ratio of coil defect and occurrence ratio of breakout to the magnetic flux density (in FIG. 3, gas blowing amount: 18±2 Nl/min, stroke: 6–8 mm, oscillation number: 240–260 cpm; in FIG. 4, gas blowing amount: 28±2 Nl/min, stroke: 6–8 mm, oscillation number: 240–260 cpm; the other c6nditions are the same as in FIGS. 1 and 2). When a static field is applied at a magnetic flux density of not less than 0.5 T to both the meniscus portion and the lower portion of molten steel jet, the entrapment of powder and the occurrence ratio of breakout become very small.

Moreover, when the magnetic flux density of a static field applied to the meniscus portion is not more than 0.35, even if the throughput is not less than 6 t/min, the occurrence ratio of coil defect is not less than 0.25% irrespectively of single-hole nozzle and multihole nozzle.

In FIG. 5*a* shows the relation between superheat of molten steel surface in a mold for continuous casting and the nail depth, as shown in FIG. 5*b*, of an oscillation mark in the surface of a cast slab when the magnetic flux density is 0–1.25 T. As seen from FIG. 1*a* and FIG. 5*a*, the nail depth is mitigated by simultaneously applying a static field having a high magnetic flux density to both the meniscus portion and the lower portion of molten steel jet to maintain the superheated superheat of molten steel surface at a high level. By mitigating the nail depth is decreased amounts of inclusion, powder and bubbles caught with the nail portion, so that it is considered to lower the defect ratio in the cold rolled coil product.

In the invention for the high-speed casting at a throughput of molten steel of not less than 6 t/min, the continuous casting is carried out so as to satisfy a condition of $S \cdot F \geqq 450$ (S: up-and-down stroke of a mold for continuous casting (value between maximum value and minimum value of amplitude)(mm), F: oscillation number (cpm)) during the feeding of molten steel through the immersion nozzle. Because, when conducting the high-speed continuous casting aiming at the invention, the stabilization of the molten steel flow is a great factor for preventing the occurrence of breakout and internal defect of a cast slab, and also it is important to stably flow a mold powder thereinto. For this end, the continuous casting is particularly necessary to be carried out under the above condition, whereby the disorder of oscillation mark is removed and the mark depth is reduced. This condition is preferable to be $S \cdot F \geqq 1000$.

Moreover, as the value of oscillation number (vibration frequency) F becomes higher, the consumption of powder becomes large and the depth of oscillation mark is reduced, so that it is preferably not less than 150 cpm, more particularly not less than 200 cpm. And also, the maximum value is about 600 cpm from viewpoints of mitigation of disorder degree of oscillation waveform and maintenance of powder consumption and the like.

When the high-speed casting is particularly carried out at a throughput of molten steel of not less than 6 t/min, preferably not less than 7 t/min, more particularly not less than10 t/min for the production of surface-carefree cast slab assuming the direct rolling, the above effect becomes more remarkable, and also it can be prevented to deeply invade molten steel of higher temperature into a position lower than a discharge side of the mold for continuous casting, whereby the remelting of solidification shell is avoided. Moreover, the throughput of molten steel of 6 t/min is a case assuming the continuous casting for slabs having a thickness of 0.22 m and a width of 1.2 m, in which the casting rate $V_c$ is about 2.9 m/min.

Figure 6A:
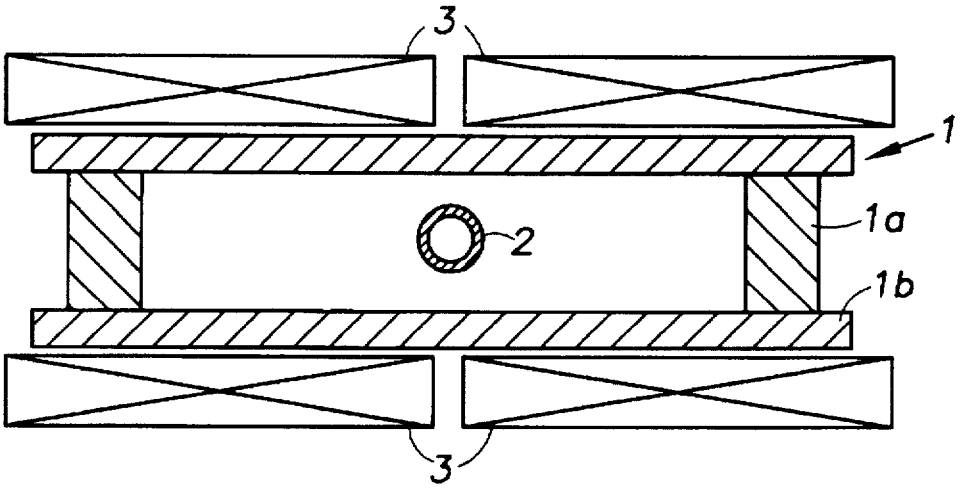
FIGS. 6*a* and *b* are diagrammatic views illustrating the construction of an equipment suitable for carrying out the invention.

In FIGS. 6*a* and *b* is shown a construction of an installation (mold for continuous casting) suitable for carrying out the invention.

In this figure, numeral 1 is a mold for continuous casting combining a pair of short-side walls 1*a* and a pair of long-side walls 1*b*, numeral 2 an immersion nozzle feeding molten metal into the mold 1 for continuous casting, numeral 3 an electromagnet (superconducting electromagnet) applying static field between mutual long-side walls 1*b* of the mold 1 for continuous casting, in which the electromagnet 3 is disposed at the rear of the mold 1 for continuous casting.

In the installation shown in FIGS. 6*a* and *b*, when static field having a magnetic flux density of not less than 0.5 T is applied with the electromagnet 3 (meniscus portion: 0.5 T, lower portion of molten steel jetted: 0.5 T) during the feeding of molten steel through the immersion nozzle 2, braking force is applied to the molten steel jet by an electromagnetic force (Lorenz force) resulting from an induction current generated by the interaction between the static field and the molten steel jet to form a decelerated uniform flow and hence there is caused no entrapment of the mold powder and the deep invasion of inclusion for catching with the solidification shell.

Figure 7A:
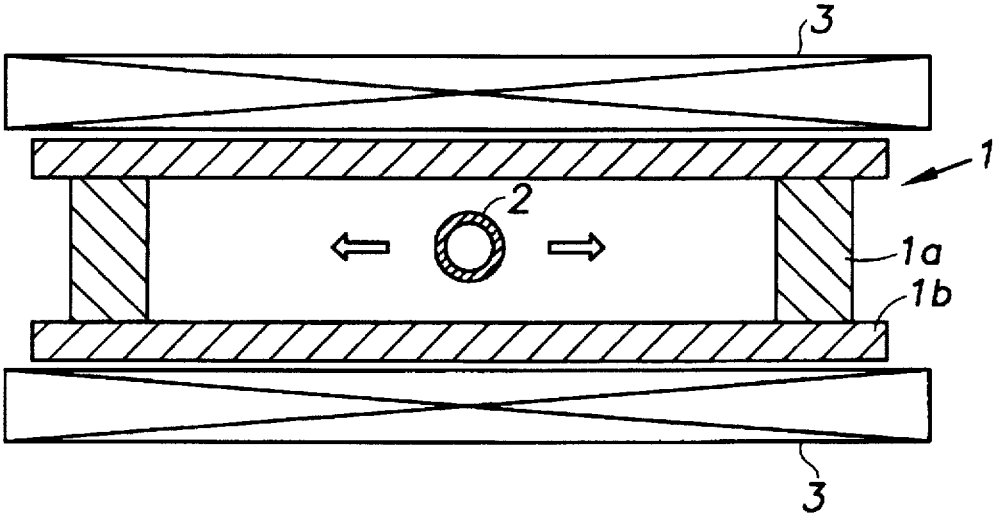
FIGS. 7*a* and *b* are diagrammatic views illustrating the construction of another equipment suitable for carrying out the invention.

FIGS. 7*a* and *b* are a case that the static field is applied to a full region in widthwise direction of the long-side wall 1*b* in the mold for continuous casting (provided that static field of not less than 0.5 T is applied to the meniscus portion and the lower portion of molten steel jetted). In this case, the flow of molten steel jetted out from the immersion nozzle 2 is rectified while flowing in uniform magnetic field irrespectively of the variation of operation conditions such as discharge angle, discharge rate and the like.

When the electromagnets 3 are arranged on upper and lower positions from the discharge port 2*a* of the immersion nozzle 2 as shown in FIGS. 8*a* and *b*, the jet of molten steel can be enclosed between the upper and lower electromagnets, so that the reduction of invasion depth of the jet containing inclusions and the tranquilization of meniscus are simultaneously attained but also the temperature drop of molten steel in the mold can be controlled.

Figure 6B:
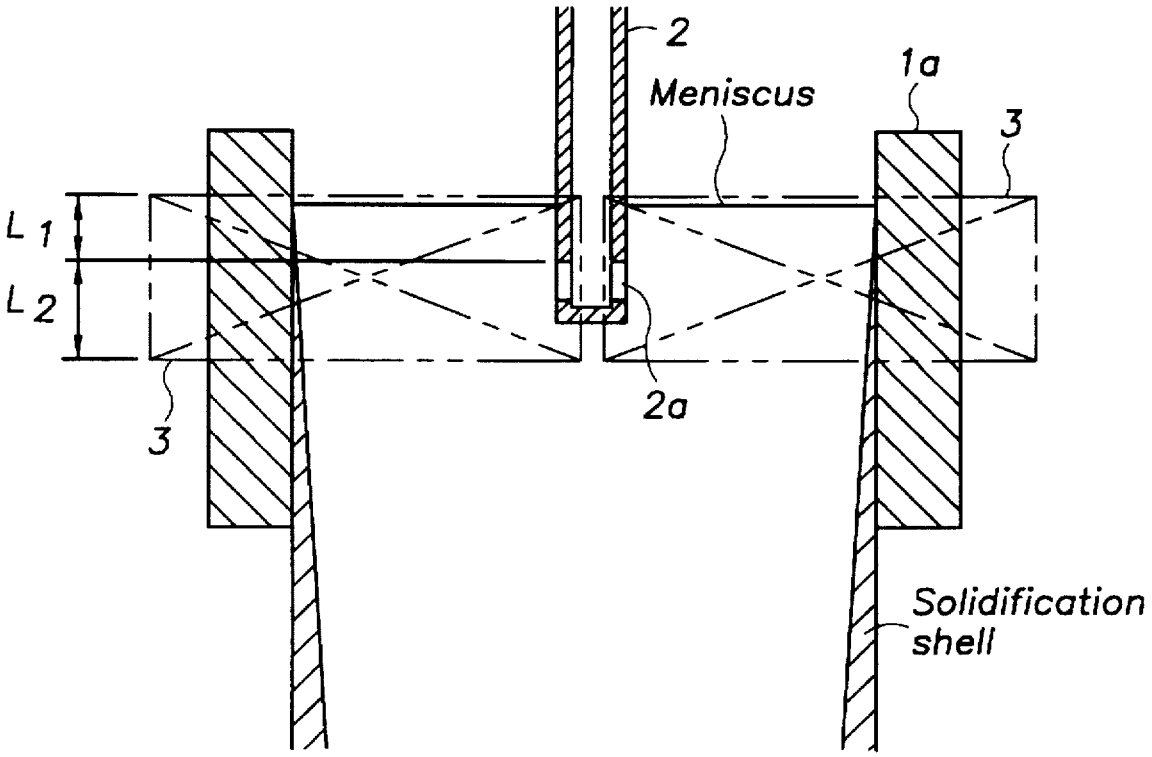
Figure 7B:
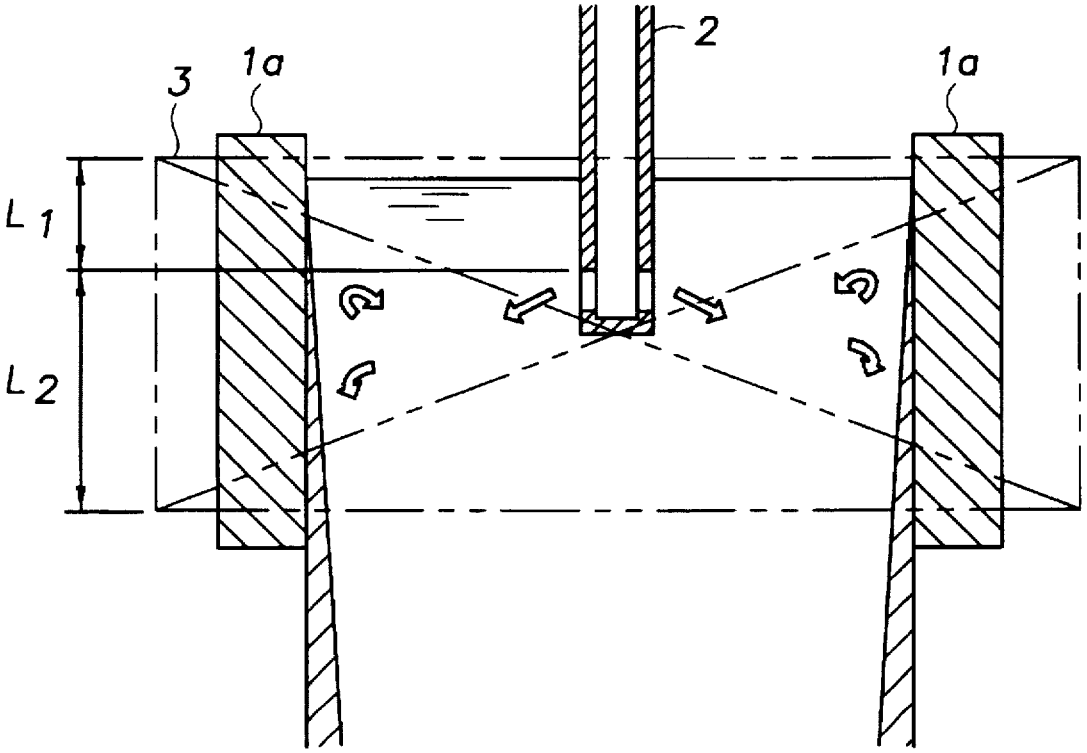

Although the multihole type immersion nozzle is shown in all of FIGS. 6–8, the single-hole type immersion nozzle can be used in the invention, and the similar results are obtained.

Figure 9A:
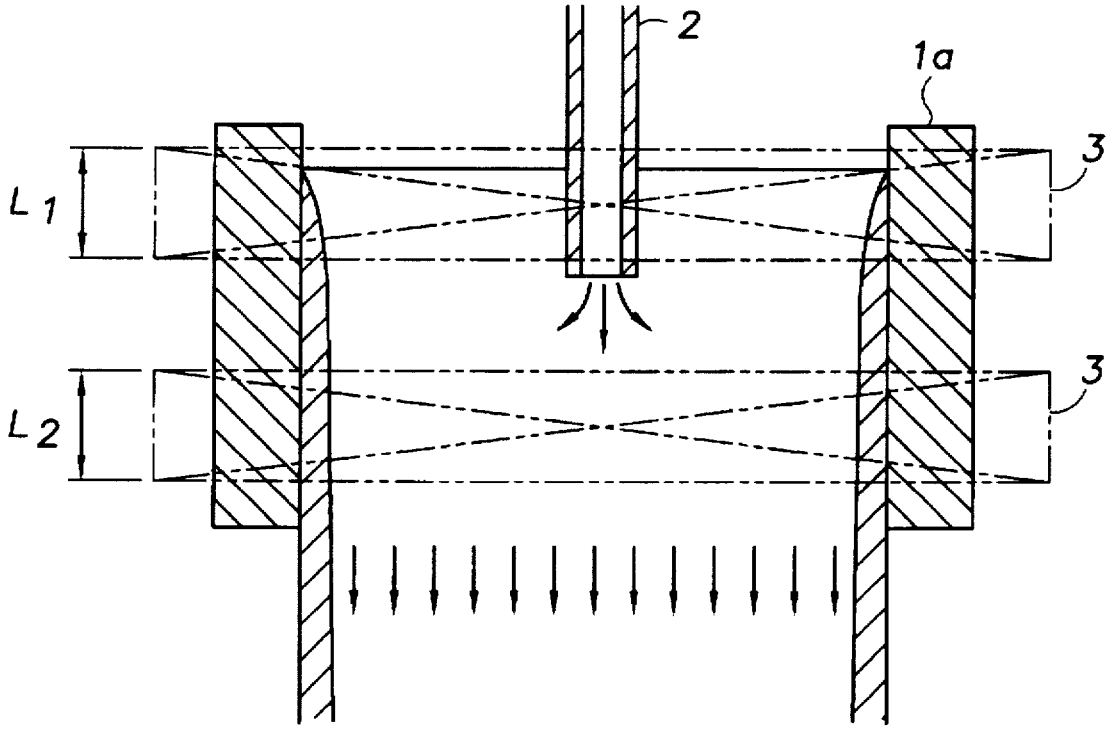
FIGS. 9*a* and *b* diagrammatic views illustrating the construction of still further equipment suitable for carrying out the invention.

In FIGS. 9*a* and *b* is shown a case of using a single-hole type straight nozzle as the immersion nozzle.

In such an immersion nozzle, the jet of molten steel invades into a deeper position, so that there is a fear of remelting the solidification shell and invading inclusions and bubbles, but the flow rate of molten steel is decelerated by the static field located beneath the immersion nozzle and, at the same time the invasion of inclusions and gas bubbles is prevented and the downstream flow is uniformized. On the other hand, the reflection current (induction current) and the upstream flow formed by the magnetic field are weakened by the static field in the meniscus portion and hence the disorder of molten steel surface becomes small.

When the electromagnets are arranged at up-and-down positions as shown in FIGS. 9*a* and *b*, the arrangement may be a region more effectively developing the application of magnetic field from the arranging relation to the immersion nozzle, but it is desirable that the magnetic poles are different in the up-and-down positions and the opposed faces, respectively.

Figure 10:
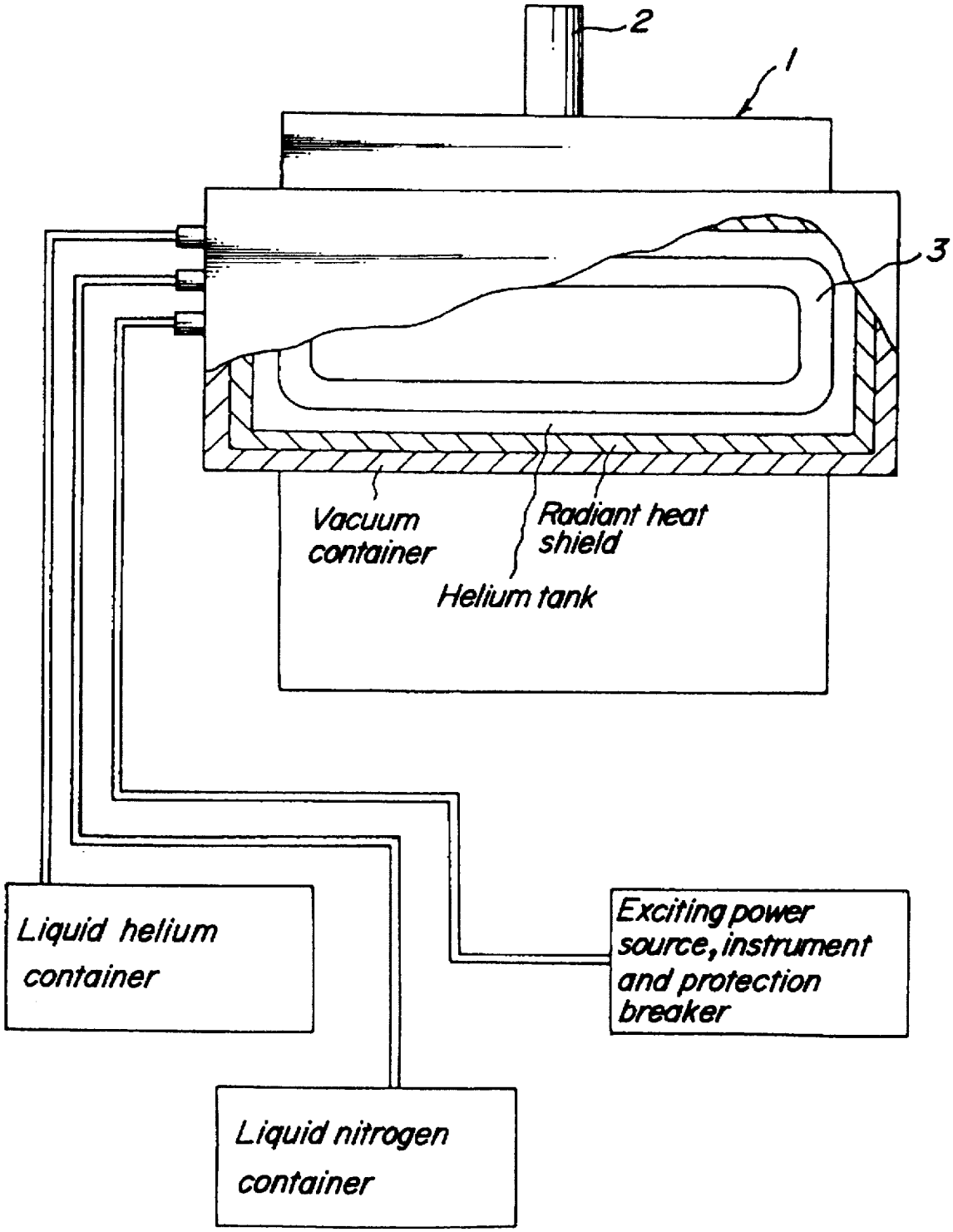
FIG. 10 is a diagrammatic view illustrating the construction of a superconducting electromagnet for the generation of static field.

FIG. 10 shows a construction of the electromagnet 3 for the generation of static field suitable for carrying out the invention. The magnet 3 comprises a helium tank, a radiant heat shield and a vacuum container surrounding them to prevent the entering of heat due to convection, in which the helium tank is connected to a liquid helium container and the radiant heat shield is connected to a liquid nitrogen container, respectively. The magnet 3 is always cooled by the liquid helium to be held at not higher than −268.9° C. A liquid nitrogen is always fed from the liquid nitrogen container to the radiant heat shield so as not to directly provide heat from exterior to the helium tank. Each of the containers is provided with a refrigerating machine (not shown), whereby each vaporized gas is again cooled and liquefied for recover into each container.

When the superconducting electromagnet as shown in FIG. 10 is used as an electromagnet for the generation of a static field, a higher magnetic flux density is obtained, but also an iron core is not used, so that the weight reduction can be attained as compared with the conventional normal-conducting type electromagnet. Further, it is not necessary to always pass current, so that energy-saving is very advantageously attained.

In the application of a static field, it is advantageous to use the above superconducting electromagnet. The normal-conducting electromagnet comprises an iron core, a coil surrounding the iron core, a power source passing current to the coil and the like. In such a normal-conducting electromagnet, it is necessary to increase the winding number of coils or increase the size of the iron core or increase the current value passing to the coil in order to provide a larger braking force. There are the following problems in the continuous casting using the normal-conducting electromagnet:

1) Since the normal-conducting electromagnet is directly attached to the back of the mold for continuous casting, Lorenz force moving molten steel in the mold in up and down directions is generated with the up-and-down vibration (oscillation) of the mold to promote the variation of molten steel surface. Further entrapment of the mold powder becomes prevalent.
2) Since the iron core of the normal-conducting electromagnet has a weight of not less than several dozens of tons, inertia force accompanying the vibration of the mold increases, so that there is a limit for increasing the vibration frequency of the mold.
3) When the high-speed casting is carried out at a throughput of molten steel exceeding 6 ton/min, it is necessary to apply a static field so as to have a magnetic flux density of not less than 0.5 T, so that it should be attempted to increase the number of winding coils or the size of the iron core and hence the problems of the above items 1) and 2) become more conspicuous. In addition, a large force is applied to the cooling plate constituting the mold to bring about the deformation thereof (stress acting on the cooling plate becomes large in proportion to square of an intensity of magnetic field), during which molten steel is leaked out from a gap formed in the mold to break the solidification shell and bring about the breakout.

In the invention, the superconducting electromagnet is used in order to solve the aforementioned problems. In this case, the superconducting electromagnet is arranged independently of a support system for the mold and a mutual distance between the superelectromagnets may be changed by reciprocally approaching and separating them in accordance with the casting condition to adjust the magnetic flux density of the static field.

When the superconducting electromagnet is used as a means for applying the magnetic field to the mold for continuous casting, it is possible to attain the compactness of the installation (total weight can be controlled to not more than several tons) and the braking force to molten steel can largely be improved, so that the deterioration of quality due to the entrapment of inclusion or the like is mitigated and it can easily be coped with the high-throughput, high-speed casting.

The superconducting electromagnet is arranged on each rear surface of the opposed side walls in the mold for continuous casting. However, when the superconducting electromagnet oscillates accompanied with the oscillation of the mold, the superconducting state is broken to cause so-called quenching, so that the support system for the mold (not shown) is separated from the support system for the superconducting electromagnet as shown in FIG. 11, whereby the mutual superconducting electromagnets can reciprocally be approached to or separated away from each other.

Figure 11:
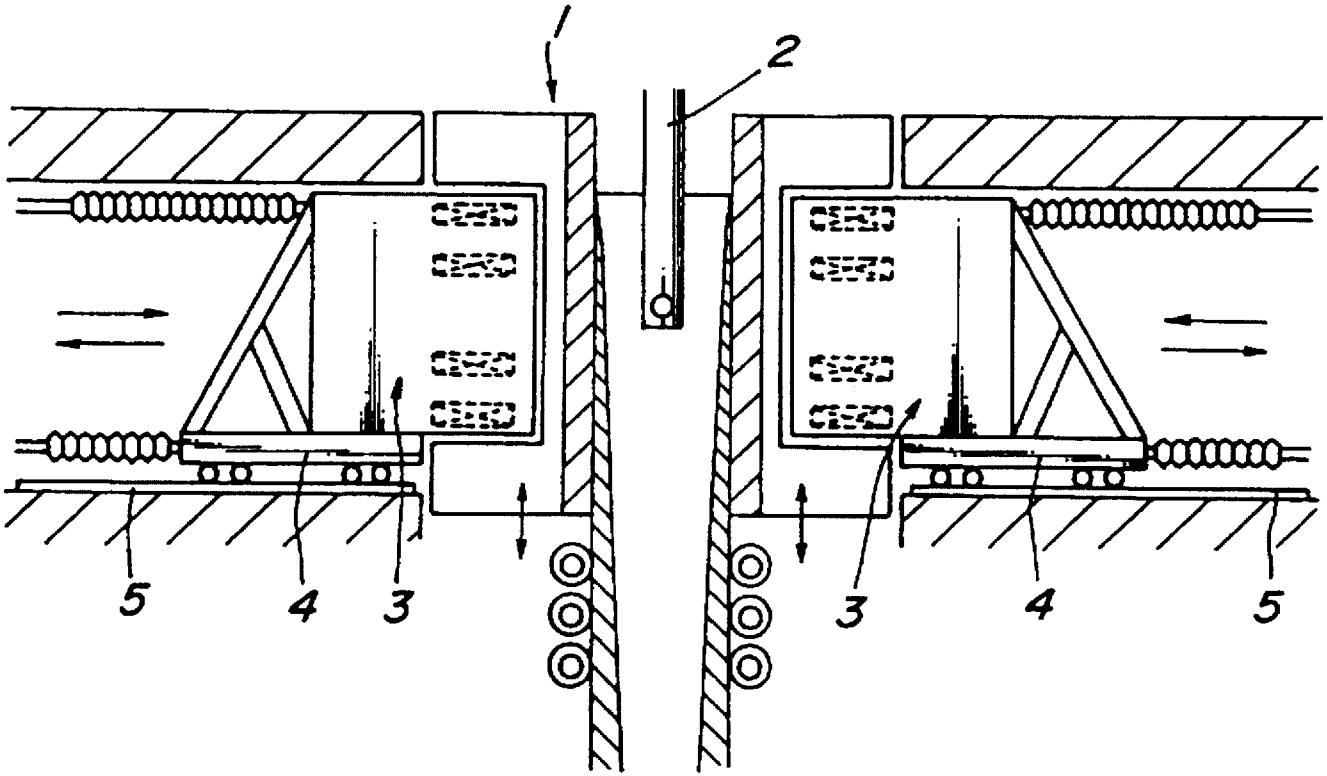
FIG. 11 is a diagrammatic view illustrating the construction of a mold for continuous casting suitable for carrying out the invention.
Figure 12:
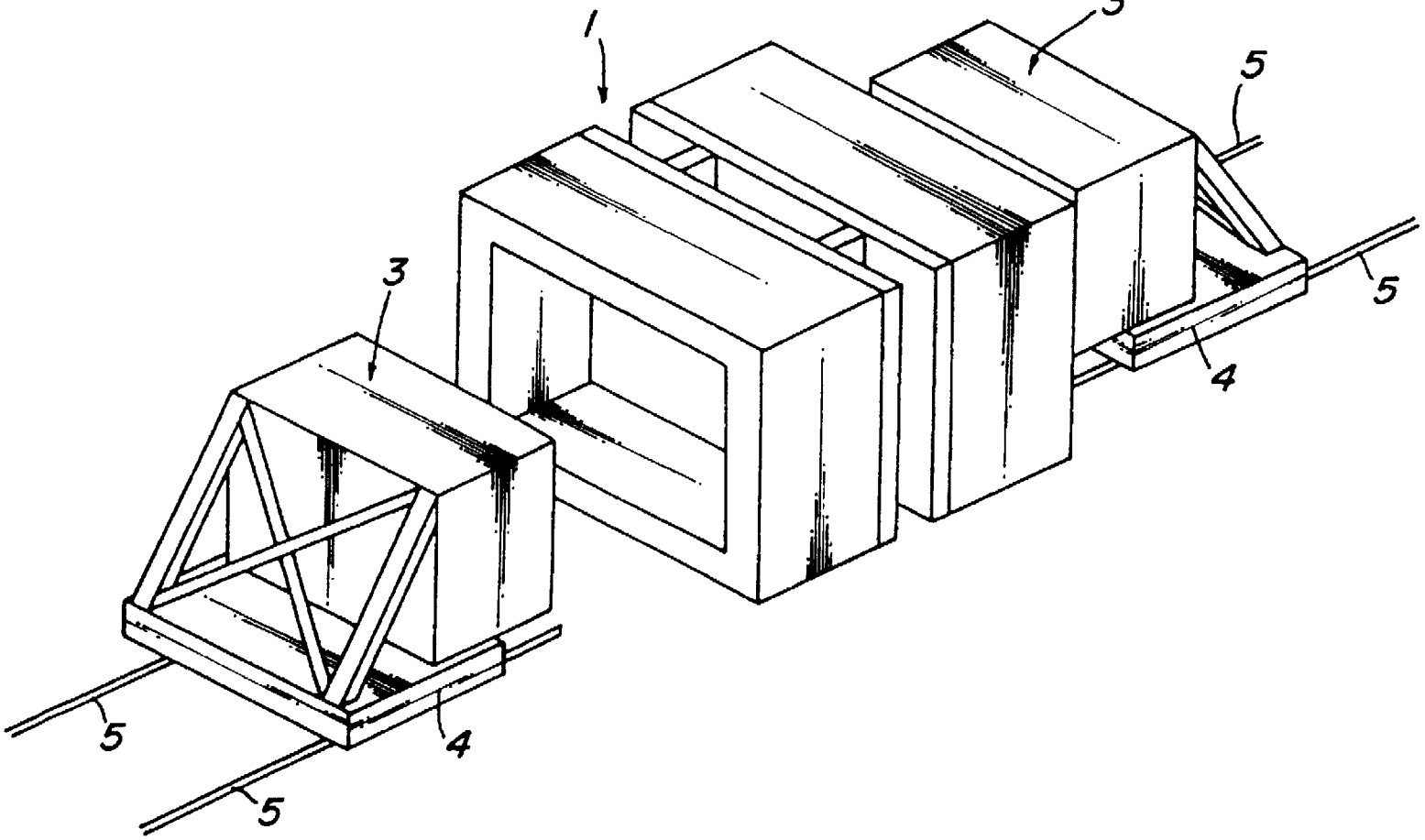
FIG. 12 is a perspective view of FIG. 11.

As shown in FIG. 11, the superconducting electromagnet 3 is placed on a truck 4 disposed on the rear of the mold 1 for continuous casting, and the truck 4 is reciprocally moved along a rail 5 to change a distance between magnetic poles, if necessary, whereby the magnetic flux density can simply be adjusted even in the casting. In FIG. 12 is shown a perspective view of FIG. 11.

Furthermore, the superconducting electromagnet 3 is not affected by the oscillation of the mold 1 owing to the adoption of the above construction, so that Lorenz force moving molten steel in up and down directions in the mold is not generated and the force deforming the cooling plate of the mold is not applied and hence the continuous casting can stably be conducted.

A great merit of using the movable superconducting electromagnet is as follows:

After current slows in the superconducting electromagnet, when the supply of the current is stopped to render the magnet into an electrically shortcircuit and insulating state, magnetic field can semi-permanently be applied without continuously flowing the current. However, when the arranging position of the superconducting electromagnet is constant (fixed), if its is necessary to adjust the magnetic flux density in accordance with the casting condition (exchange of tundish or immersion nozzle during the continuous casting, or a case that an operator should approach to the mold), the insulating state must be released to change current value. In this case, electric energy is excessively consumed, so that there is caused an inconvenience of damaging the merit in the use of the superconducting electromagnet. According to the invention, the superconductive electromagnets can reciprocally be approached to or separated away from each other, so that the magnetic flux density can simply be adjusted without wastefully consuming wasteful energy.

Figure 13:
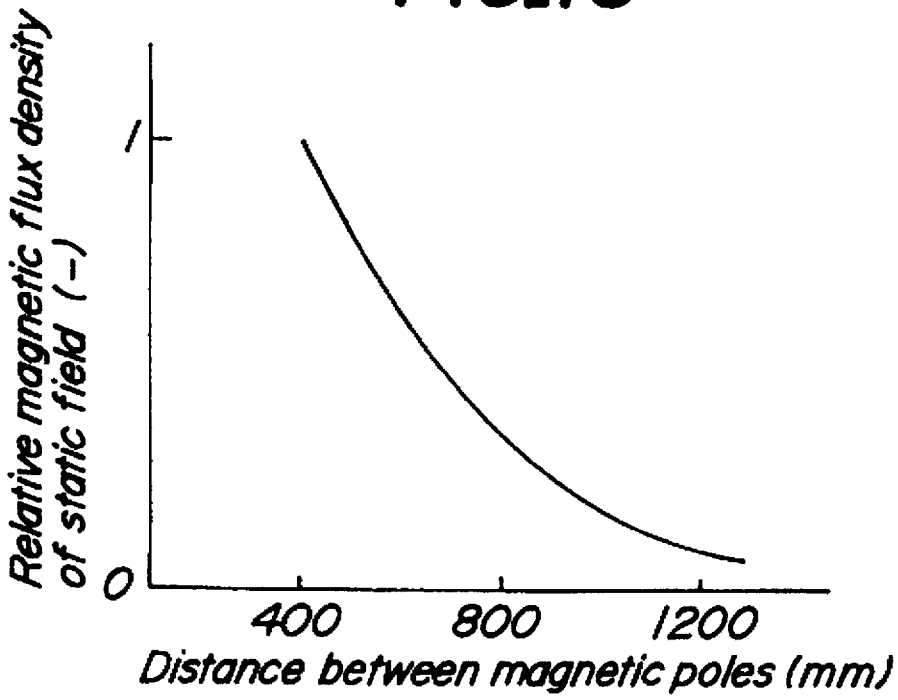
FIG. 13 is a graph showing a relation between a distance between magnetic poles and a relative magnetic flux density of static field.
Figure 14:
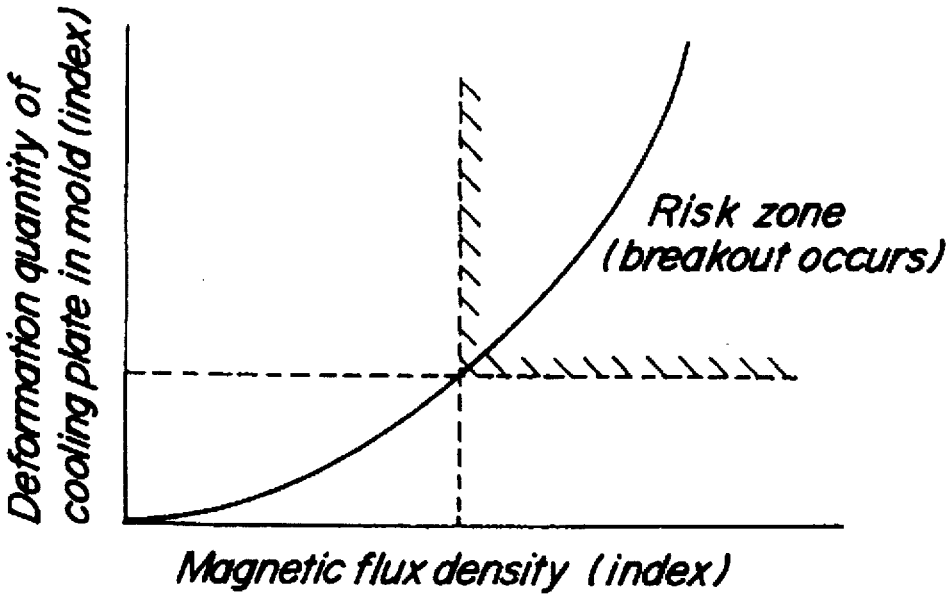
FIG. 14 is a graph showing a relation between a magnetic flux density (index) and a deformation quantity (index) of a cooling plate in a mold.

In the mold for continuous casting shown in FIG. 11, the state of varying the magnetic flux density (relative magnetic flux density) when changing the distance between magnetic poles of the superconductive electromagnets is shown in FIG. 13, and the state of deforming the cooling plate of the mold when the superconducting electromagnet is fixed to the mold for continuous casting (the support system for the superconducting electromagnet is the same as the support system for the mold) is shown in FIG. 14, respectively.

Next, there will be described a case that the flow of molten steel jetted out from the discharge port of the immersion nozzle is controlled by applying current in the mold for continuous casting in the high-throughput, high-speed casting accompanied with the application of a static field.

Figure 15B:
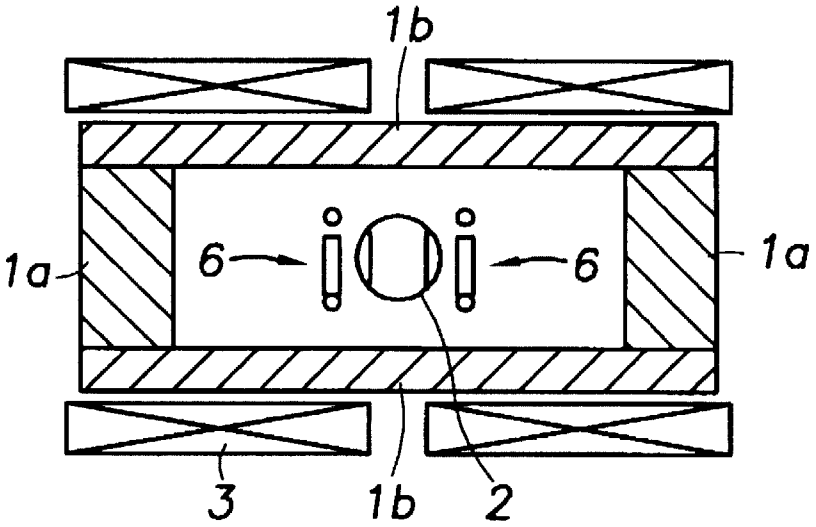
FIGS. 15*a* and *b* are partial section views of a main part of a continuously casting apparatus according to the invention, respectively.
Figure 15A:
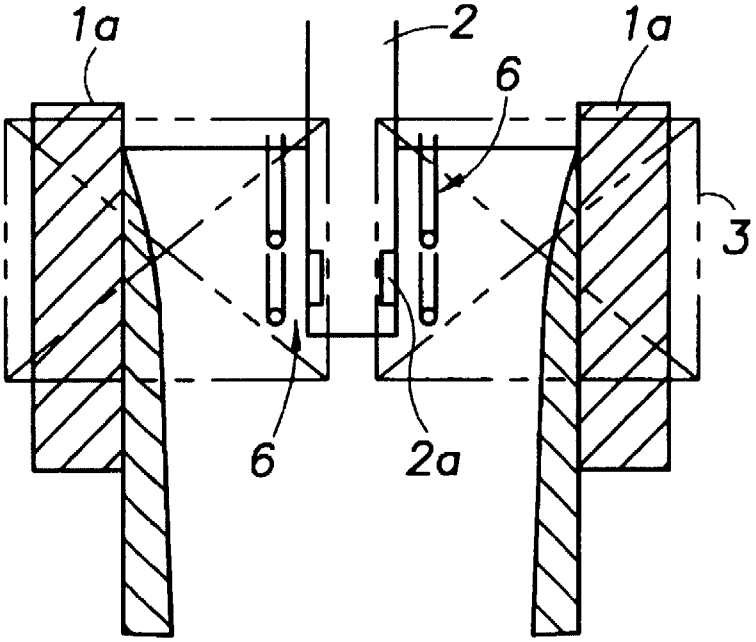
Figure 16:
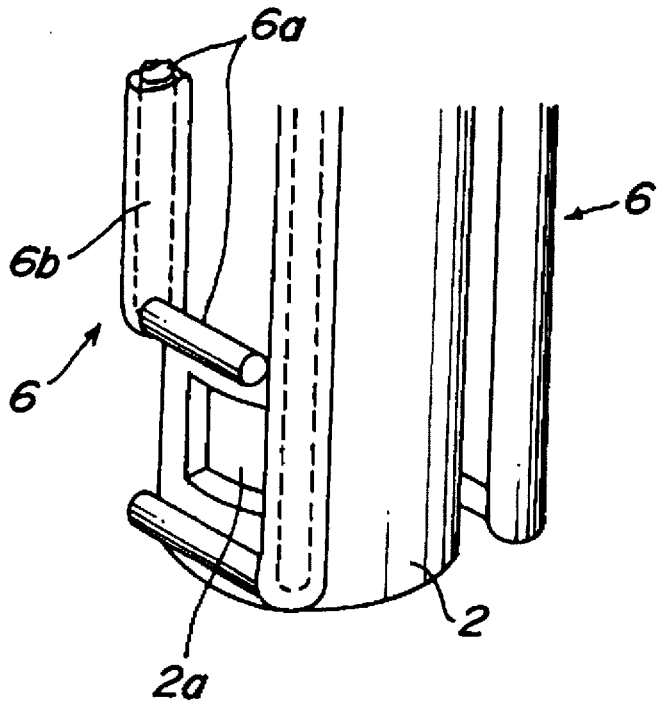
FIG. 16. is a diagrammatic view illustrating a main part of an electrode.

In FIGS. 15*a* and *b* is shown a state of arranging electrodes 6 for the application of current in the mold 1 for continuous casting. The electrode 6 is comprised of a conducting portion 6*a* and an insulating portion 6*b* as shown in FIG. 16. In case of using the multihole type immersion nozzle, the conducting portions 6*a* of the electrode 6 are arranged on the upward and downward positions of the discharge port 2*a*.

When the mold for continuous casting is used so as to have a construction as shown in FIGS. 15*a* and *b* and current is applied (current flows from the conducting portion 6*a* at the upper position of the discharge port 2*a* toward the conducting portion 6*a* at the lower position, i.e. current flows in a direction along a drawing direction of a cast slab) with the application of a static field having a magnetic flux density of not less than 0.5 T to the meniscus portion and the lower portion of molten steel jetted, even if the high-speed casting is carried out at a throughput of molten steel exceeding 6 t/min, the flow rate of molten steel jetted out from the discharge port of the immersion nozzle becomes very small and hence inclusions and the like included in molten steel are not caught with the solidification steel without deeply invading thereinto.

Figure 17B:
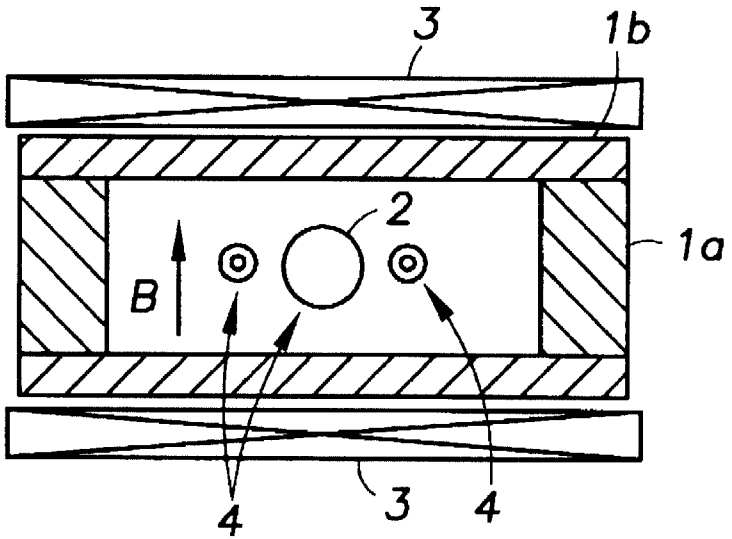
FIGS. 17*a* and *b* are diagrammatic views illustrating the construction of a mold for continuous casting suitable for carrying out the invention.
Figure 17A:
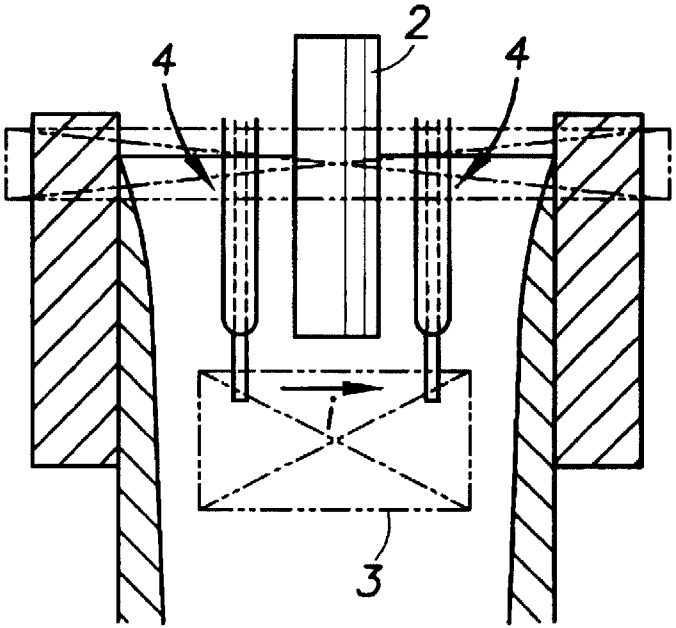

In FIGS. 17*a* and *b* is shown a case of using a single-hole type immersion nozzle 2. In the continuous casting using the mold of such a construction, current i slows in a direction perpendicular to the long-side wall 1*b* of the mold 1, whereby the flow rate of molten steel jetted is reduced like in the case shown in FIGS. 15*a* and *b*.

Figure 18B:
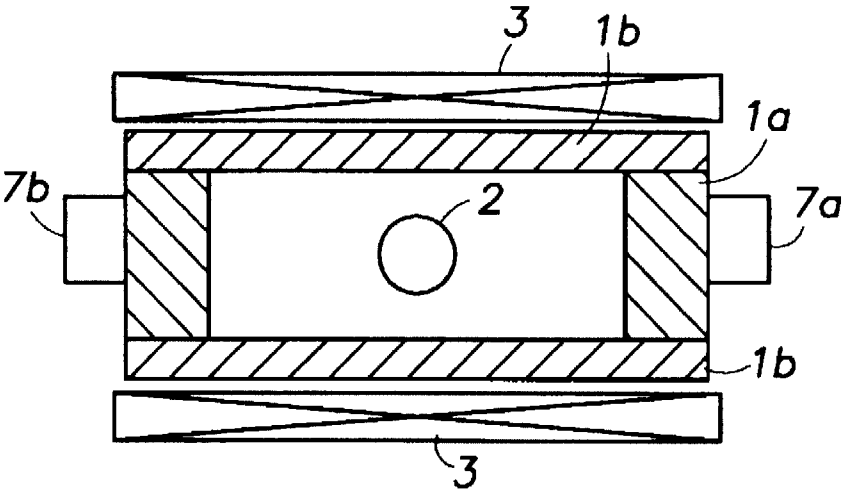
FIGS. 18*a* and *b* are diagrammatic views illustrating the construction of another mold for continuous casting suitable for carrying out the invention.
Figure 18A:
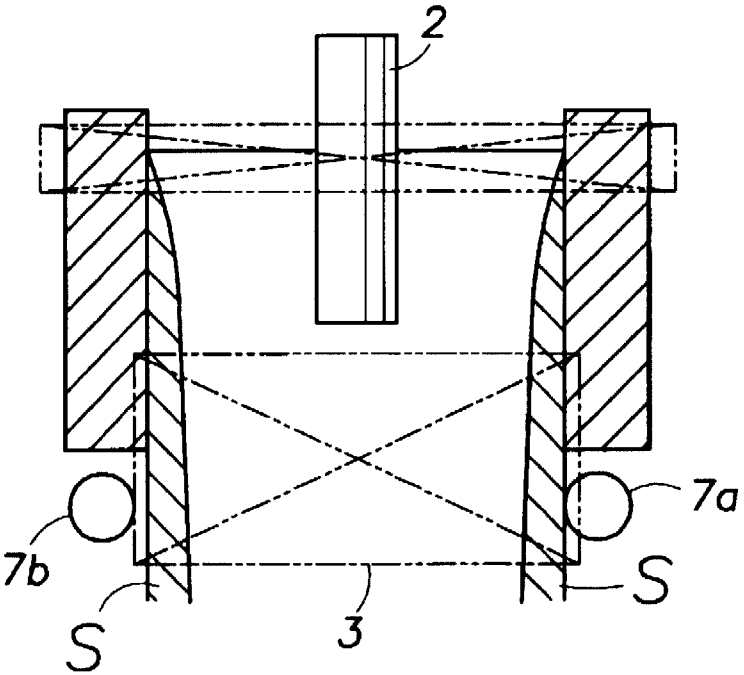

In the continuous casting using the single-hole type immersion nozzle 2, FIGS. 18*a* and *b* show a case where a static field is applied to the meniscus portion in the mold 1 and the full width at the lower end thereof, while current is applied between mutual opposed walls of the solidification shell S just beneath the delivery side of the mold 1 through electrode rolls 7*a*, *b*.

In continuous casting using a mold of such construction, there are advantages in that the flow of molten steel jetted out from the immersion nozzle 2 is offset by an upstream flow generated by the application of static field and the flow of current and also the stirring of molten steel in the mold can be expected, while a uniform downstream flow can be obtained without causing the variation of molten steel surface due to the upstream flow.

Figure 19B:
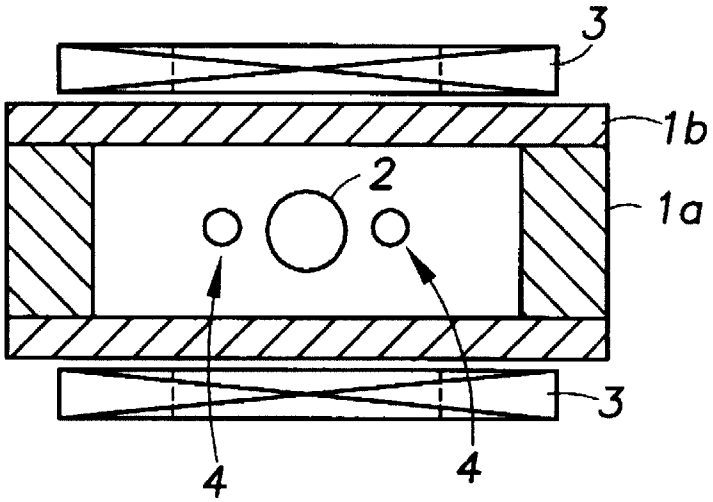
FIGS. 19*a* and *b* are diagrammatic views illustrating the construction of the other mold for continuous casting suitable for carrying out the invention.
Figure 19A:
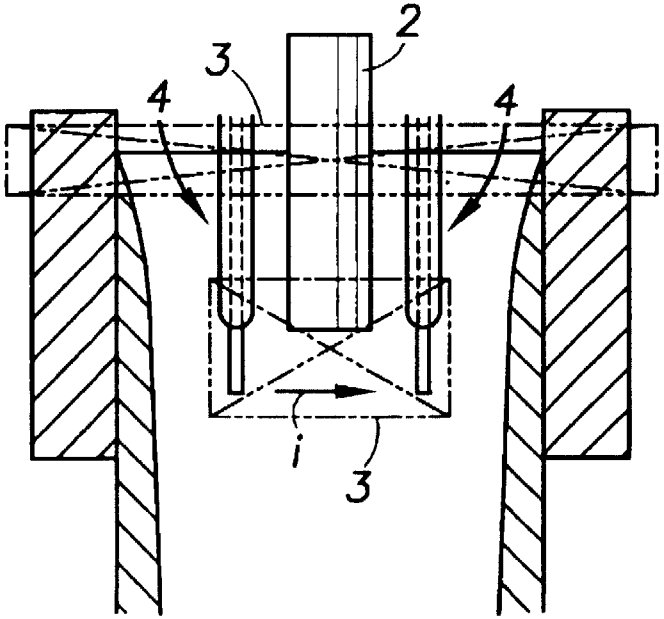

In FIGS. 19*a* and *b* is shown in case that static field is applied to full width of an upper part (meniscus portion) of the mold 1 and a region including the discharge port of the immersion nozzle 2, while current i flows in a direction perpendicular to the long-side wall 1*b* of the mold 1 in the continuous casting using the single-hole type immersion nozzle 2. In such a continuous casting, it is possible to attain not only the reduction of the flow rate of molten steel jetted but also the control and tranquilization of variation of molten steel surface in the mold.

Moreover, the region of applying static field and the region of flowing current differ in accordance with the construction of the immersion nozzle and the casting condition, so that they are not limited to only the cases of FIG. 15 to FIG. 19.

Figure 20:
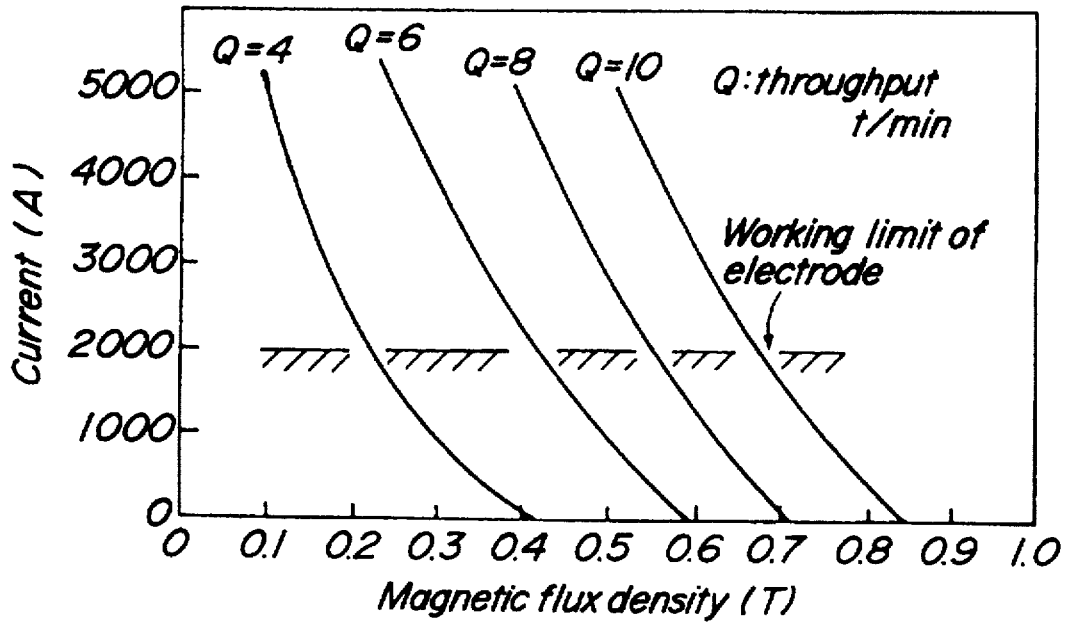
FIG. 20 is a graph showing a relation between a magnetic flux density and a current.

FIG. 20 is a graph showing a relation between a magnetic flux density of static field and a value of current when molten metal of a low melting point alloy having substantially the same properties as molten steel is subjected to continuous casting (when castable flow rate at the lower end of the mold is previously determined by conducting fluid and heat transfer calculations based on data obtained in actual machine, the flow rate lower than the determined value is castable) using the single-hole type immersion nozzle (casting model experiment).

When current flows in the mold for continuous casting, it is considered that a value of current not withstanding to the operation due to self-heat buildup of the electrode or cable is restricted to about 2000 A even from a viewpoint of heat transfer of molten steel. In the invention, even when the current value is range of above limit range of 2000 A, the flow of molten steel jetted can be controlled by applying static field so as to have a magnetic flux density of not less than 0.5 T, so that it can easily be coped with the high-speed casting at a throughput of molten steel of 6–10 ton/min.

In the invention, it is preferable that current applied to the mold is about 400 A–2000 A from viewpoints of the above self-heat buildup of cable, electrode or the like and an efficiency of upstream flow generated by static field and current and so on.

Figure 21:
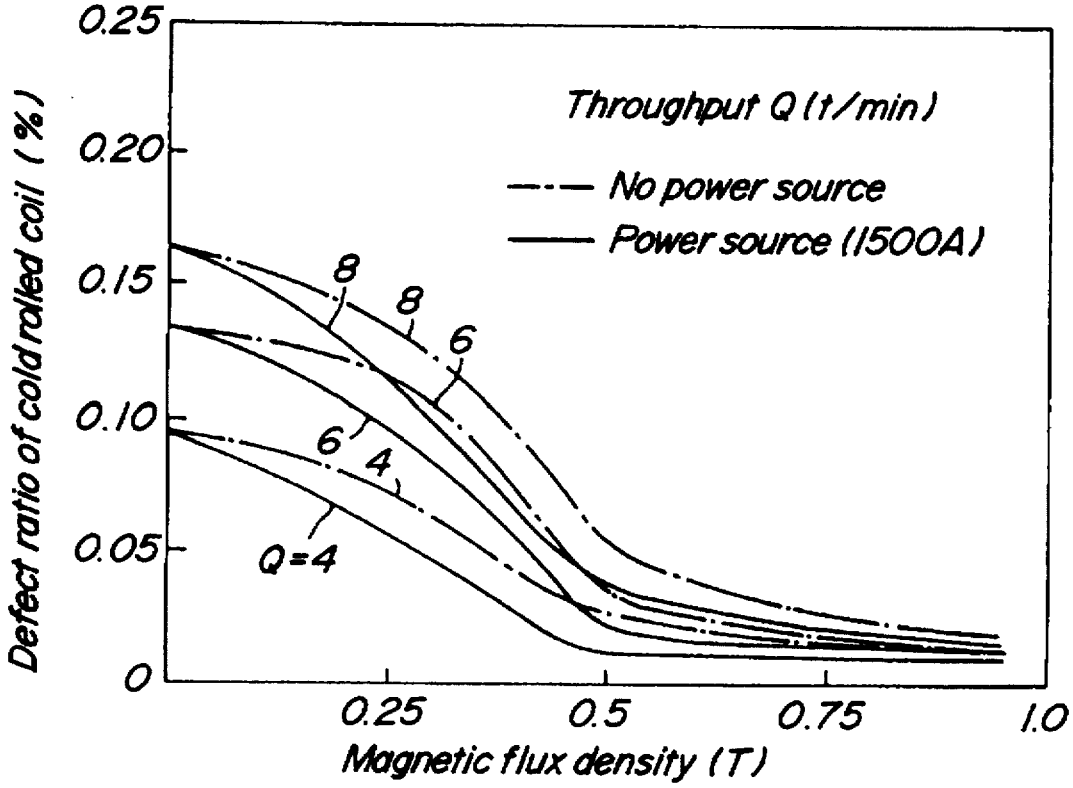
FIG. 21 is a graph showing a relation between a magnetic flux density and an occurrence ratio of cold rolled coil.

In FIG. 21 is shown results examined on the state of generating coil defect ratio when extremely-low carbon steel is subjected to continuous casting by varying the magnetic flux density of static field applied in the mold for continuous casting (meniscus portion: 0.5 T, lower portion of molten steel jetted: 0–10 T, FIG. 6) and the resulting cast slab is finished to a cold rolled coil.

The occurrence ratio of coil defect is considerably decreased on a border at the magnetic flux density of about 0.5 T (both the meniscus portion and the lower portion of molten steel). Particularly, when current flows in the mold, the deflected flow of molten steel is suppressed and the coil defect ratio is further reduced.

Then, there is described a case where flow of molten steel is effectively controlled by arranging electrical terminals on the short-side walls of the mold for continuous casting so as to form a closed circuit flowing induction current thereinto during the application of static field.

Figure 22:
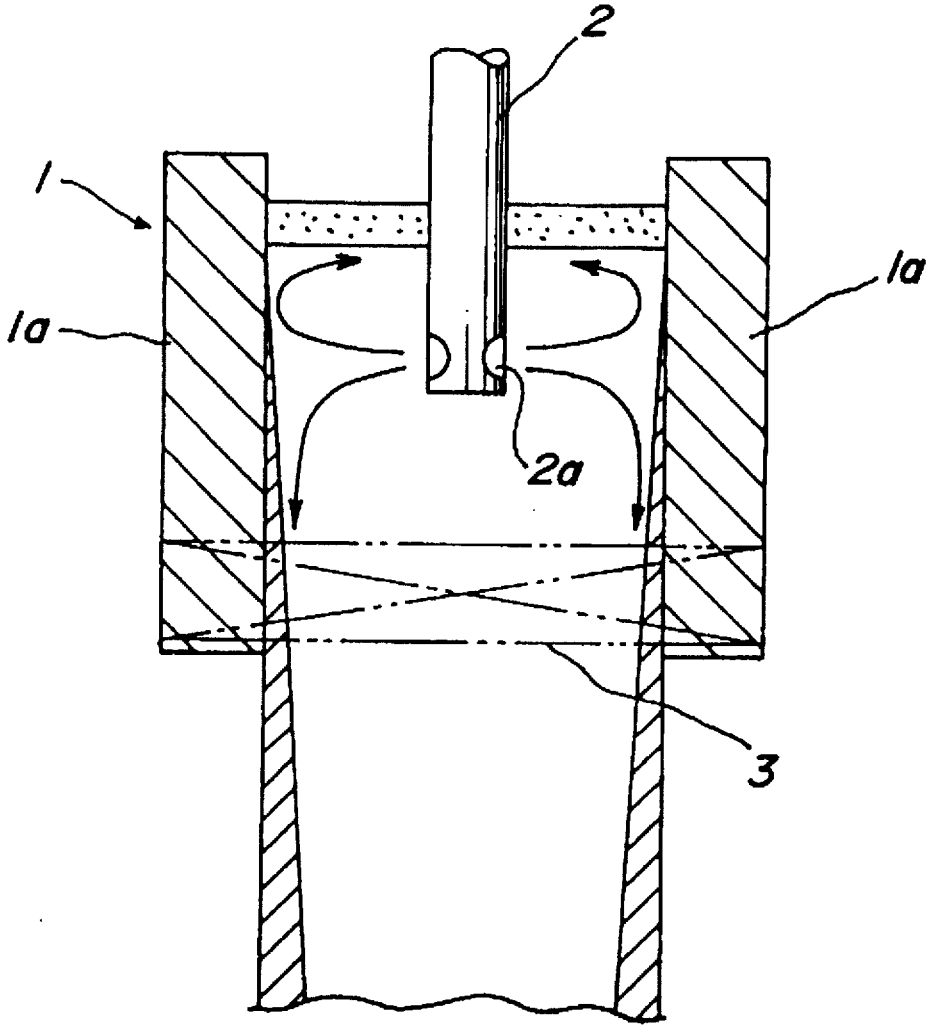
FIG. 22 is a diagrammatic view illustrating a continuously casting state according to the conventional system.

At first, when two-hole type immersion nozzle is used as the immersion nozzle 2 as shown in FIG. 22, the discharge port 2*a* faces to the short-side wall 1*a* of the mold, so that molten steel jetted out from the immersion nozzle 2 into the mold also faces to the short-side wall 1*a* of the mold to divide into upstream flow and downstream flow as shown by arrows.

As to the downstream flow, there is a problem that inclusions or bubbles included in molten steel are deeply invaded in craters to cause internal defects in the resulting cast slab. Therefore, the downstream flow can be decreased by Lorenz force generated by an interaction between a static field and the molten steel jet when the static field is applied to molten steel in the mold by the electromagnet 3. In the high-speed casting under conditions that the throughput of molten steel is 6 t/min and the static field is applied so as to have a magnetic flux density of not less than 0.5 T, however, there arise the following problems.

Figure 23A:
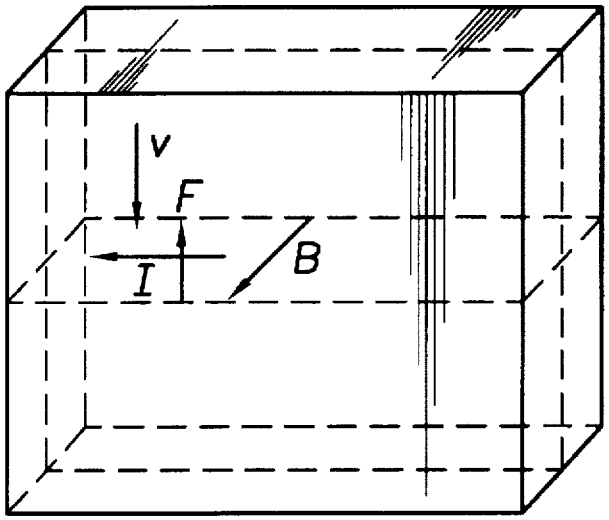
FIGS. 23*a*, *b* and *c* are schematic views illustrating states of accelerating a jet of molten steel through reflection current, respectively.
Figure 23B:
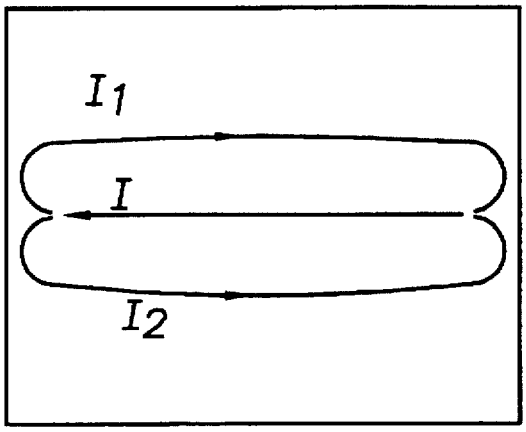
Figure 23C:
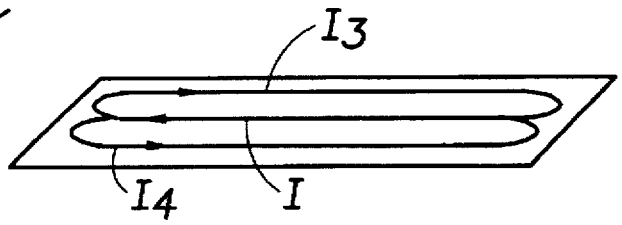

When static field B is applied for decreasing the flow rate v of the downstream flow as shown by a perspective view in FIG. 23*a*, induction current I flows by an interaction between downstream flow rate v and static field B and hence a force F is created in a direction opposite to the flowing direction of molten steel by an interaction between the induction current I and the static field B to decrease the downstream flow rate. However, the induction current I forms an electric circuit in molten steel to generate currents $I_1$, $I_2$, $I_3$, $I_4$in a direction opposite to the induction current I as shown by longitudinal section in FIG. 23*b* and by transverse section in FIG. 23*c*.

Since magnetic flux passes from the electromagnet through regions of currents in a direction opposite to the induction current I or so-called reflection currents, a force directing opposite to a braking force for the flow of molten steel is created by an interaction between the reflection current and the static field. This means that the braking force for the molten steel flow is offset by the presence of the reflection current. The intensity of the reflection current becomes large as the downstream flow becomes fast and the magnetic field applied becomes strong, so that even if it is intended to more effectively control the molten steel flow, the reflection current may be an obstacle to providing good results.

In the invention, therefore, electrical terminals leading the induction current are arranged on the short-side walls of the mold and communicated with each other through a conducting means to flow the induction current in molten steel from one of the terminals to the other terminal.

Figure 24:
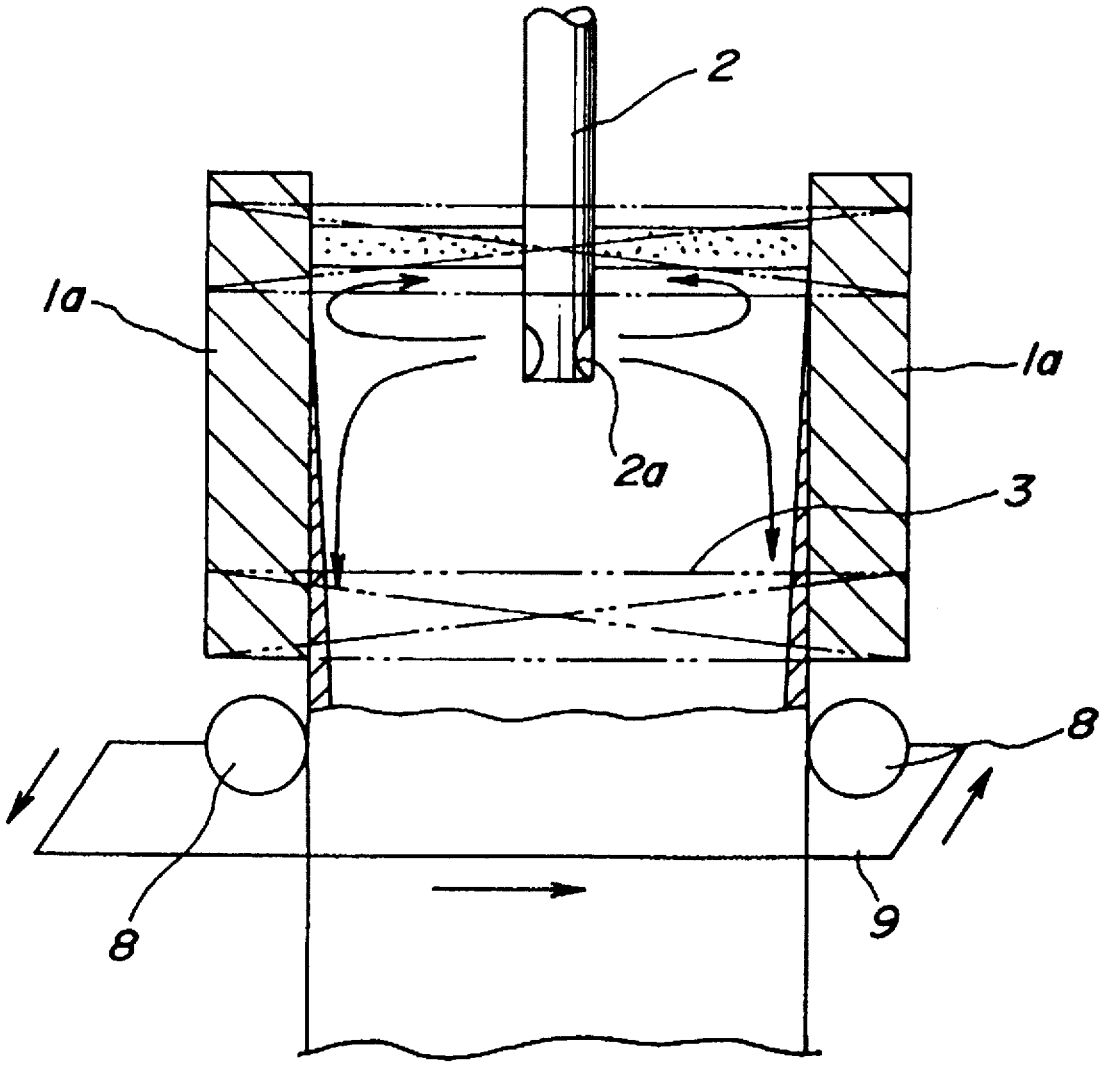
FIG. 24 is a diagrammatic view illustrating a preferable construction of a mold for continuous casting used in the invention.

A preferable case is shown in FIG. 24 as a partial section view.

In this apparatus, the lower electromagnet 3 applies a braking force to the downstream flow of molten steel likewise the case of FIG. 22, while rolls 8 are arranged just beneath the short-side walls 1*a* of the mold situating the electromagnets 3 and pressed to a cast slab and connected to each other through a conductor 9.

The rolls 8 of FIG. 24 are pressed to the cast slab and rotated in accordance with the drawing of the cast slab, so that the supply of the induction current is not interrupted.

Figure 25:
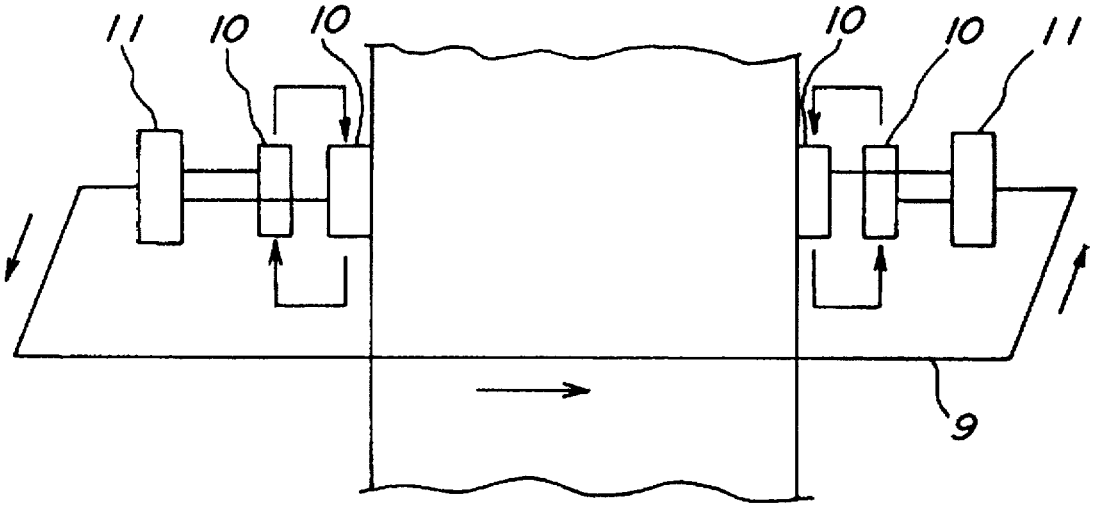
FIG. 25 is a diagrammatic view illustrating another preferable construction of a mold for continuous casting used in the invention.

Another example of the electrical terminal is shown in FIG. 25. The terminal of FIG. 25 is constructed so as to successively press a plurality of plates 10 in accordance with the drawing of the cast slab, in which each of the plates is connected to a connector 11 so as not to interrupt the supply of the induction current. An endless track may concretely be mentioned.

A means for actuating the plural plates is optional. When the terminal is a plate as shown in FIG. 25, a large contact area is advantageous.

Figure 26:
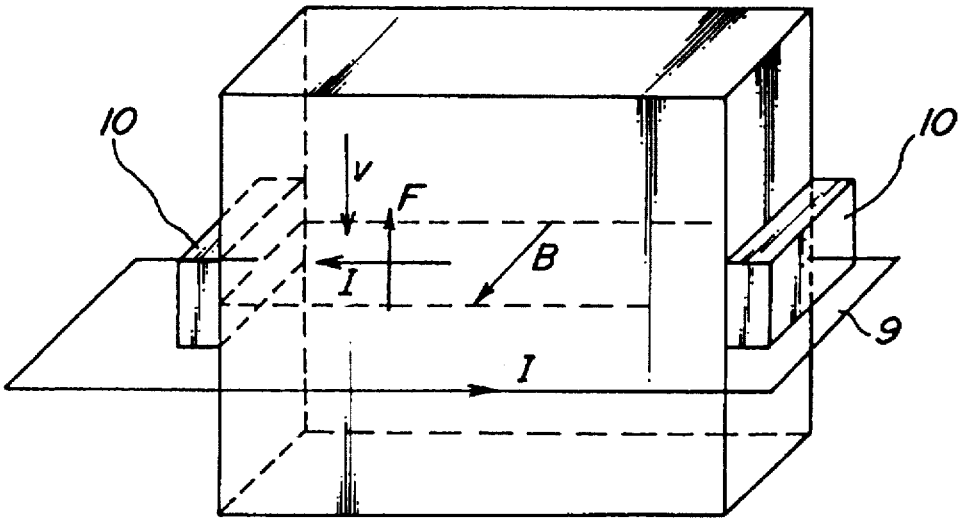
FIG. 26 is a schematic view showing a flow of induction current.

According to such a construction, the induction current is not caused in molten steel inside the mold but forms a circuit passing through the terminal and conductor as shown in FIG. 26, so that the reflection current generated in molten steel inside the mold is not created and hence the electromagnetic force is not caused in the same direction as the molten steel flow and the braking force for the molten steel flow is not offset, and consequently the control of the molten steel flow can effectively be conducted.

In the invention, the arranging position of the electrical terminal is not particularly restricted as long as the terminal is located on the short-side wall of the mold and in the vicinity of a region generating the induction current.

The apparatus is not limited to the illustrated embodiment and may take various modifications. For instance, the immersion nozzle may be a so-called straight nozzle having a single discharge port in addition to the nozzle having two discharge ports.

Next, the invention will be described in terms of a concrete apparatus when the high-throughput, high-speed casting is carried out by applying oscillations of not less than 150 cpm to the mold for continuous casting.

As previously mentioned, it is an effective means to enhance the oscillation number (vibration frequency) of the mold for continuous casting in order to ensure the stability of the operation and obtain a carefree cast slab having good surface properties in the high-speed casting.

In order to stabilize the growth of shell at an initial solidification and prevent the restraint breakout, it is desirable that a negative strip ratio (NS value) represented by the following equation is at least a positive value, preferably a higher value. The need of rendering the negative strip ratio into the positive value means that the descending rate of the mold is necessary to ensure a time faster than the casting rate.

$$NS=\{(2\cdot Sf/v)-1\}\times 100$$

where

S:up-and-down stroke of the mold for continuous casting (mm)

F: oscillation number (cpm)

v: casting rate (cm/s)

As seen from the above equation, when the casting rate v is simply increased, the negative strip ratio lowers, so that it is necessary to enhance either the mold oscillation stroke S or the oscillation number F or both.

However, when the stroke S of the mold is made large, there is a fear of bringing about the biting of solid powder in the meniscus portion of molten steel inside the mold or the clogging of powder channel due to slug rim, so that the stroke S of the mold should be made as small as possible. It is usually set to not more than 10 mm. As a result, it is required to enhance the oscillation number (vibration frequency) F of the mold for continuous casting in order to conduct the casting aimed at the invention. Further, it is advantageous to enhance the oscillation number F of the mold even in the decrease of oscillation mark depth.

In short, it is necessary to simultaneously satisfy the secure of the stability in the casting and the improvement of surface properties in the cast slab in order to realize the high-speed continuous casting by increasing the throughput amount per 1 strand. For this purpose, it is important to enhance the oscillation number of the mold.

To this end, a so-called air-core superconducting electromagnet having no iron core is utilized in the invention.

Figure 27:
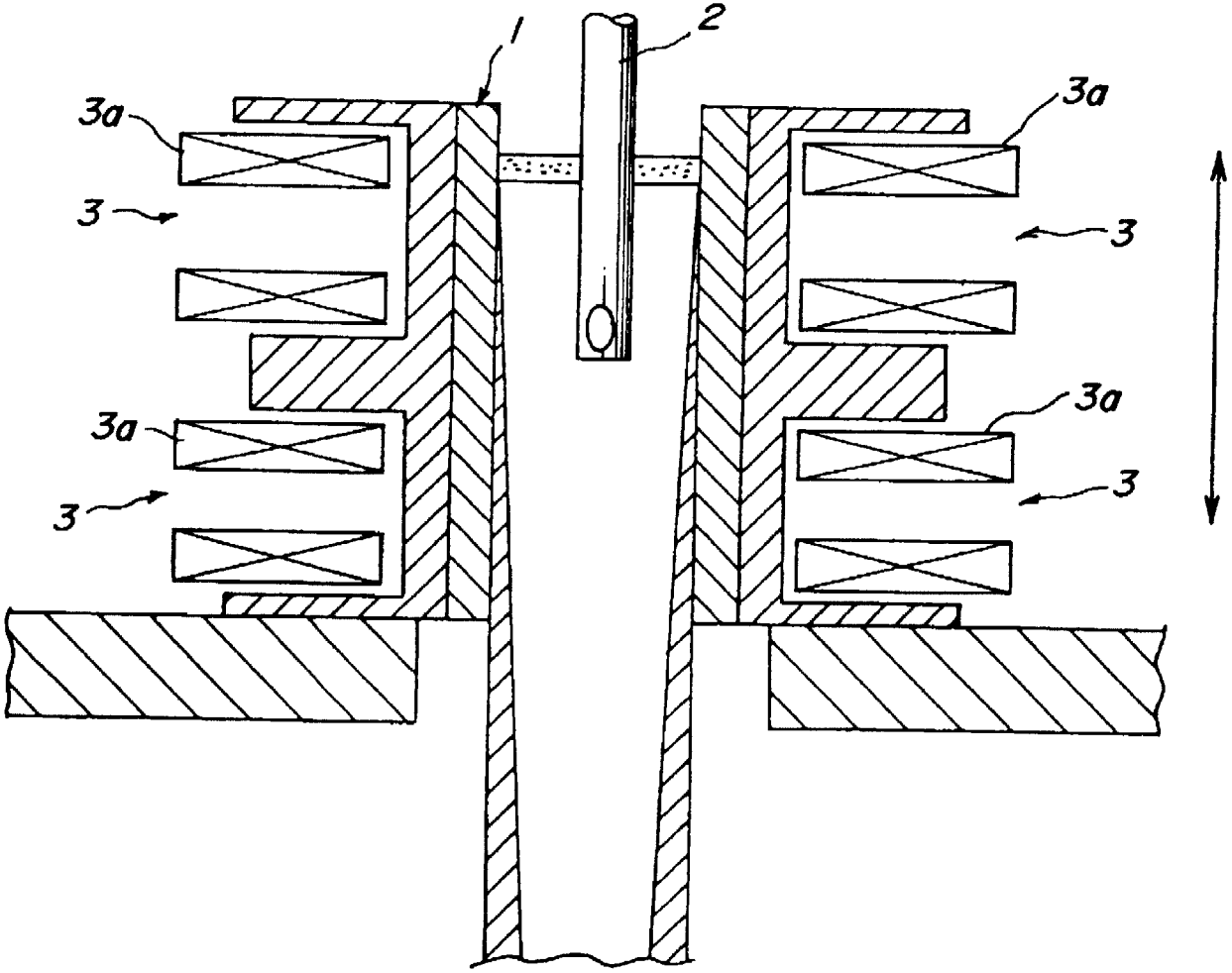
FIG. 27 is a diagrammatic view illustrating the construction of a mold for continues casting provided with an air-core superconducting electromagnet.

In FIG. 27 is sectionally shown an example of a main part of the continuous casting apparatus according to the invention.

Figure 28A:
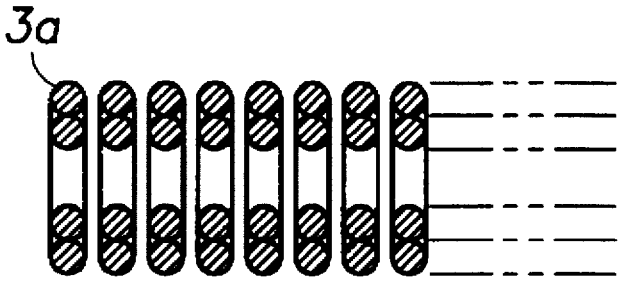
FIGS. 28*a* and *b* are diagrammatic views illustrating a main part of a superconducting electromagnet, respectively.
Figure 28B:
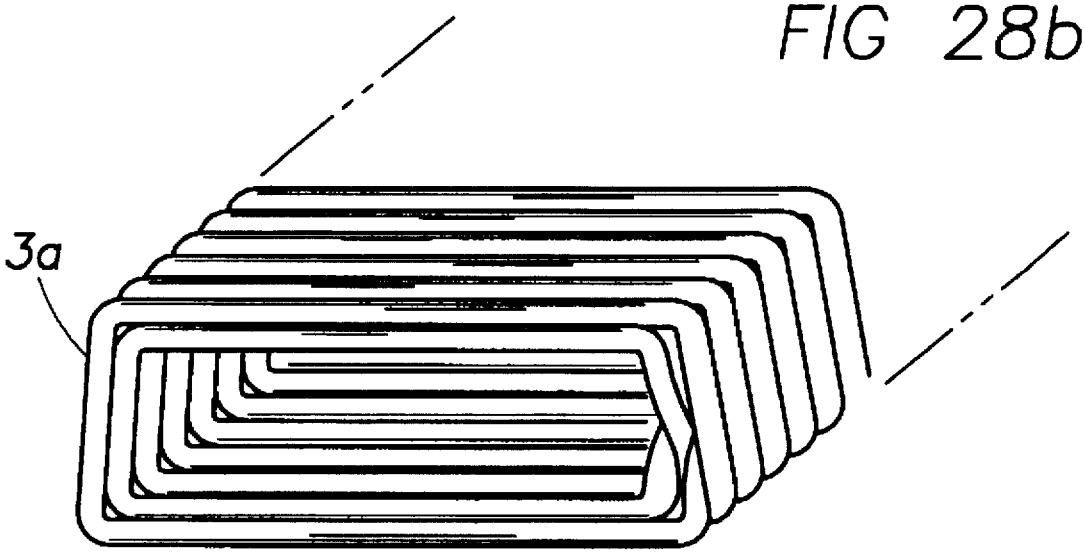

In the illustrated apparatus, the electromagnet 3 has no iron core and is comprised of only a coil 3*a* formed by superconducting wire. As a main part of the electromagnet 3 is shown in FIGS. 28*a* and *b*, the winding number is greater as compared with the wound coil of the conventional electromagnet (multi-winding) and a given magnetic flux density corresponding to the high-throughput, high-speed casting is obtained.

When using such an air-core type electromagnet, the weight of the electromagnet is decreased to 1/5–1/7 of a conventional electromagnet and the total weight of mold and electromagnet in the oscillation of the mold is mitigated by the decreased weight of the electromagnet, whereby the oscillation number of the mold can be enhanced.

In case of slabs having a size of 200–300 mm t×700–1800 mm w, the oscillation number in the conventional continuous casting apparatus is about 130–150 cpm at maximum, while the air-core electromagnet can ensure the oscillation number of not less than 200 cpm, particularly more than 220–230 cpm.

Figure 29:
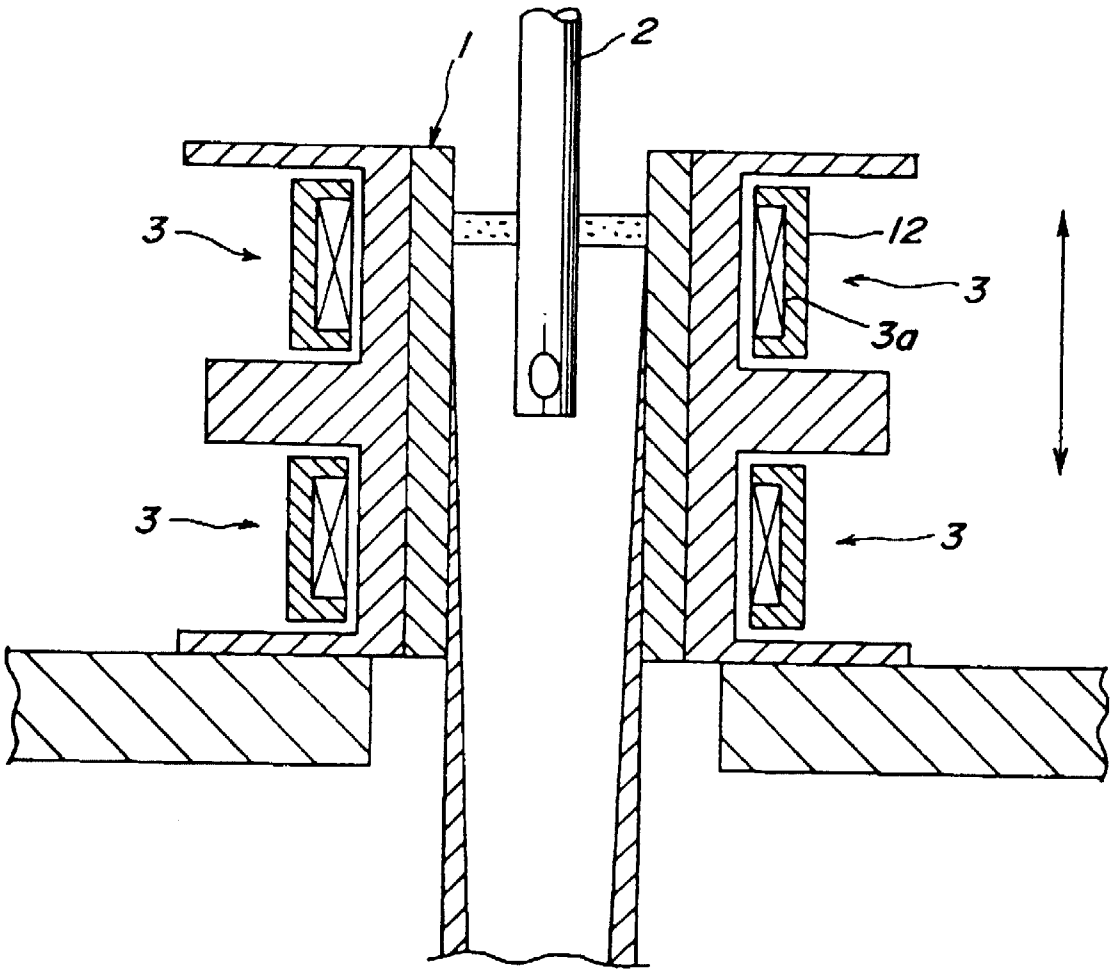
FIG. 29 is a diagrammatic view illustrating the construction of another mold for continues casting provided with an air-core superconducting electromagnet.
Figure 30:
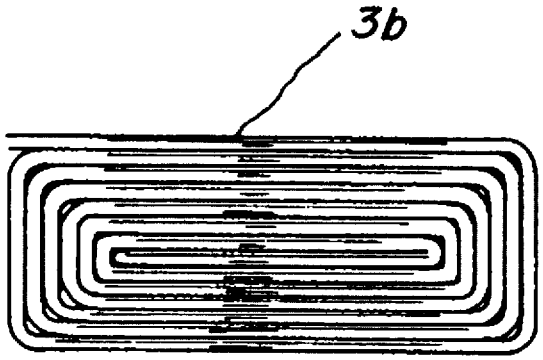
FIG. 30 is a diagrammatic view illustrating a main part of a superconducting electromagnet.

FIG. 29 shows an example provided with an electromagnet 3 comprised of a superconducting coil 3*a* by planely winding a superconducting wire as shown in FIG. 30.

In the superconducting coil 3*a*, a superconducting material such as Nb, Ti or the like may be used as a wire filament. The superconducting state is maintained by arranging a cooling box on the rear of the coil to cool with a liquid helium or the like. Moreover, the concrete construction of the cooling mechanism and the like in FIG. 29 is substantially the same as in FIG. 10.

When the apparatus provided with the superconducting electromagnet is compared with the apparatus provided with the electromagnet having an iron core, the weight can be reduced to about 90%, so that a big weight reduction can be attained but also the magnetic flux density can be made higher by 3–5 times than the conventional one (not more than about 0.3 T).

The arrangement of the air-core superconducting electromagnet to the mold may take various modification in addition to the illustrated embodiments.

BEST MODE FOR CARRYING OUT THE INVENTION

EXAMPLE 1

A slab having a thickness of 220 mm and a width of 1600 mm is cast in an amount of 260 tons per one charge by using molten steel having a chemical composition of C: 10–15 ppm, Mn: 0.15–0.2 wt %, P: 0.02–0.025 wt %, S: 0.008–0.012 wt %, Al: 0.025–0.035 wt % and T.O:25–31 ppm and conducting 600 charges of continuous casting in a continuous casting machine provided with a mold having a construction as shown in FIG. 6–FIG. 9, in which a distance between long-side walls (corresponding to a thickness of a cast slab) is 220 mm, a distance, between short-side walls (corresponding to a width of the cast slab) is 1600 mm and a superconducting electromagnet for the generation of static field having a length of 200 mm and a width of 2000 mm (kind of coil: Nb—Ti wire) is arranged on the rear of the long-side wall, under the following conditions:

Magnetic flux density: 0.5 T in meniscus portion, 1.0 T in lower portion of molten steel jetted Throughput of molten steel: 8 t/min Two-hole type immersion nozzle (FIG. 6–FIG. 8)

Figure 9B:
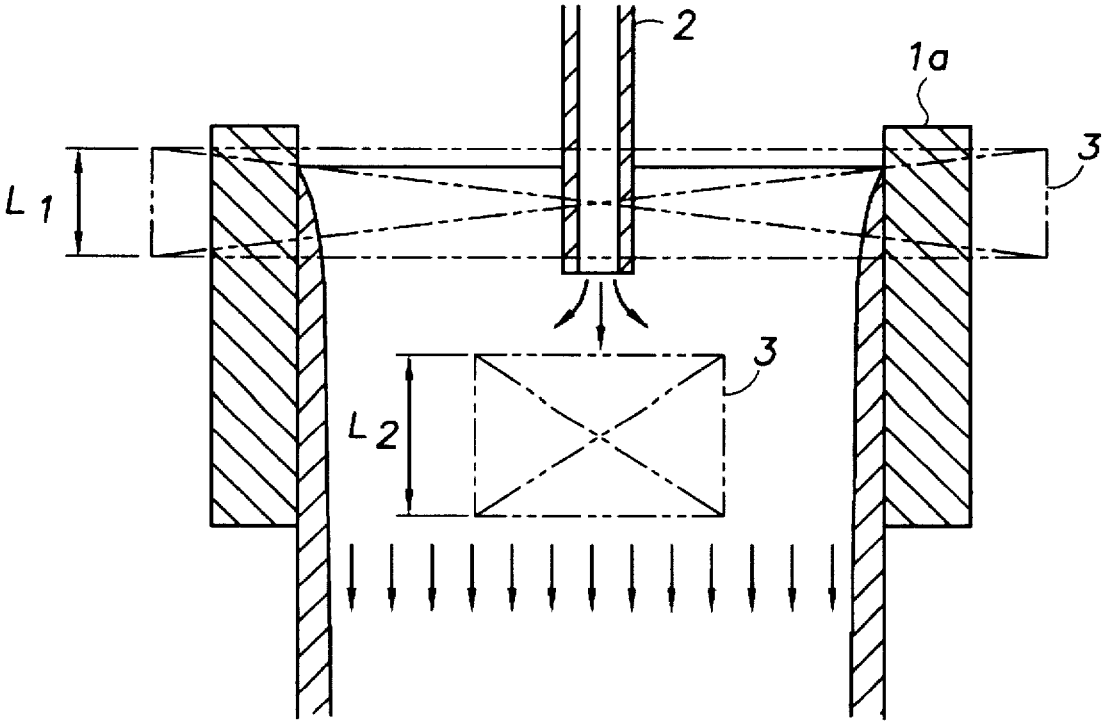

Single-hole type immersion nozzle (FIG. 9)

Nozzle size: 80 mm in inner diameter

Size of discharge port in immersion nozzle: square having a side of 80 mm (two-hole type immersion nozzle)

Discharge angle of immersion nozzle: 20° downward (two-hole type immersion nozzle)

Position of discharge port in immersion nozzle: 230 mm from meniscus up to an upper end of discharge port of nozzle Position of meniscus: position of +20 mm from upper end of coil Oscillation number of mold: 220 cpm Stroke of mold: 7 mm Casting rate: 2.89 m/min and the nozzle clogging in the casting, the state of generating breakout and internal and surface qualities (coil defect ratio) of the resulting slab are examined. The results are showing in Table 1 with qualities of slab obtained by a comparative method conducting the continuous casting under the same conditions as mentioned above except that stating field is not applied.

TABLE 1

| | Items | | | | |
|---|---|---|---|---|---|
| Application type of magnetic field | Index of nozzle clogging* | Index of molten steel temperature in mold (°C.) | Occurrence ratio of coil defect (%) | Occurrence ratio of breakout (%) | Gas blowing** |
| FIG. 6 | 0.03 | 1 ± 1 | 0.01 | ≦0.03 | blowing |
| FIG. 7 | 0.03 | 1 ± 1 | 0.01 | ≦0.03 | |
| FIG. 8 | 0.03 | 1 ± 1 | 0.007 | ≦0.03 | |
| FIG. 9 | 0 | 1 ± 1 | 0.01 | ≦0.03 | |
| no application of static field (multihole nozzle) | 0.42 | 10 ± 3 | 0.16 | 0.3 | |
| FIG. 6 | 0.04 | 2 ± 1 | 0.02 | ≦0.03 | no blowing |
| FIG. 7 | 0.04 | 2 ± 1 | 0.02 | ≦0.03 | |
| FIG. 8 | 0.04 | 1 ± 1 | 0.02 | ≦0.03 | |
| FIG. 9 | 0 | 1 ± 1 | 0.08 | ≦0.03 | |
| no application of static field (multihole nozzle) | 0.45 | 12 ± 3 | 0.15 | 0.4 | |

TABLE 1-continued

| Application type of magnetic field | Items | | | | |
|---|---|---|---|---|---|
| | Index of nozzle clogging* | Index of molten steel temperature in mold (°C.) | Occurrence ratio of coil defect (%) | Occurrence ratio of breakout (%) | Gas blowing** |

*6 continuous casting
**gas flow rate 24 Nl/min

As seen from Table 1, according to the invention, the nail depth of oscillation is made shallow and the entrapment of powder and the variation of molten steel surface can be reduced, so that it is possible to improve the surface quality and also the internal quality can be made higher. As a result, it has been confirmed that carefree cast slab can stably be produced in the high-throughput, high-speed continuous casting.

EXAMPLE 2

A slab having a thickness of 220 mm and a width of 800–1800 mm is produced by casting an extremely-low carbon Al killed steel (C: 0.001 wt %) in an installation provided with a mold for continuous casting shown in FIG. 11 under conditions that a magnetic flux density of static field is 0.2–1.0 T (distance between mutual superconducting electromagnets is adjusted at up and down positions), a throughput of molten steel is 3.0 t/min–8.0 t/min, an oscillation number is 150–240 cpm and a stroke is 7–9 mm, which is then finished into a steel sheet through rolling step and annealing step (continuous annealing line), and thereafter the surface quality of the steel sheet (occurrence ratio of surface defect in steel sheet) is examined.

Figure 31:
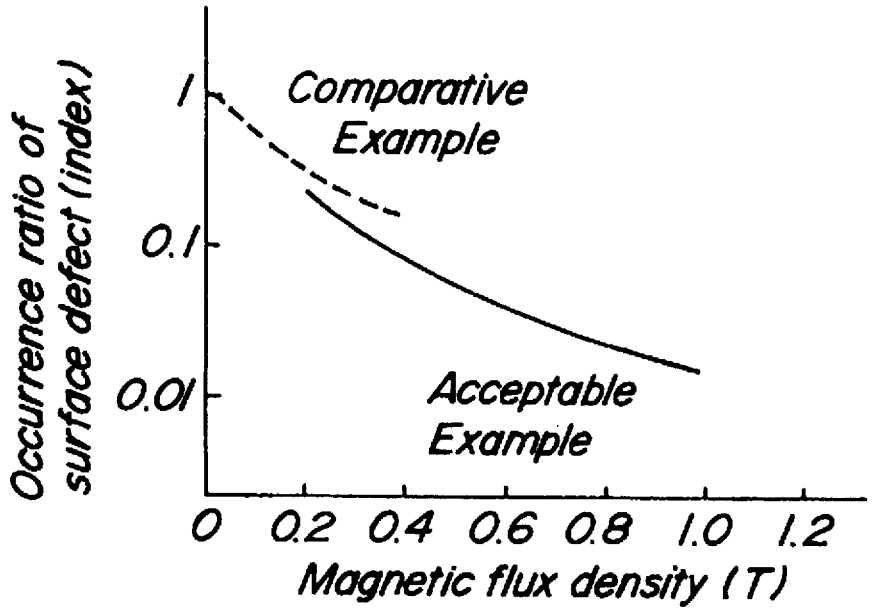
FIG. 31 is a graph showing a relation between a magnetic flux density and an occurrence ratio of surface defect.

The results are shown in FIG. 31 together with results when the continuous casting is carried out by using a normal-conducting electromagnet and fixing to the mold for continuous casting to apply static field having a magnetic flux density up to about 0.4 T (limit in the prior art).

As seen from FIG. 31, it has been confirmed that in the continuous casting according to the invention, the occurrence ratio of defect is low within a range of 0.2–0.4 T as compared with the case of conducting the continuous casting by the application of static field through the normal-conducting electromagnet and that when the magnetic flux density is increased to 1.0 T, it is possible to effectively decelerate the flow of molten steel jetted out from the immersion nozzle and hence the entrapment of inclusions and the like can be mitigated to more reduce the occurrence ratio of defect.

EXAMPLE 3

A continuous casting is carried out by using an apparatus having a construction as shown in FIG. 24 according to methods A–E under the following conditions.

Conditions

Kind of steel to be cast:

Extremely-low carbon aluminum killed steel (C: 15–25 ppm, P: 0.015–0.020 wt %, S: 0.01–0.015 wt %, Al: 0.03–0.04 wt %, T.O: 25–28 ppm)

Continuous casting machine:

vertical bending type continuous casting machine having a vertical portion of 2.5 m Size of mold:

width of 1600 mm and thickness of 220 mm corresponding to size of cast slab

Immersion nozzle: 25° downward, two-hole nozzle

Casting rate: 3.5 m/min

Oscillation number of mold: 220 cpm

Stroke of mold: 8 mm

Application of static field:

static field is applied so that the magnetic flux density is equal in both the meniscus portion and the lower portion of molten steel jetted.

Throughput: 8.62 t/min

Method A: no electromagnet

Method B: normal-conducting electromagnet, magnetic flux density: 0.3 T

Figure 32:
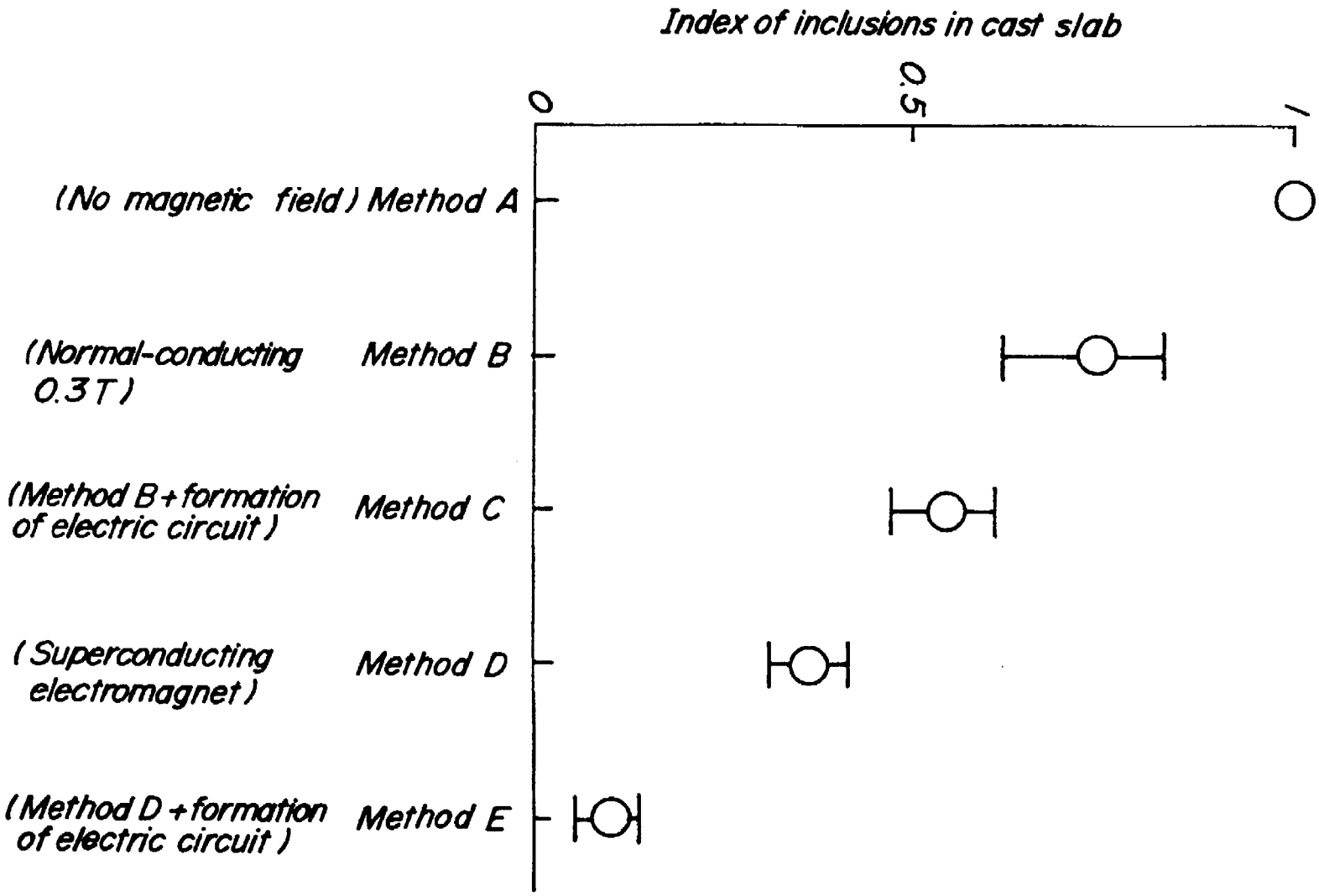
FIG. 32 is a graph showing results of measurements of inclusions in a cast slab.

Method C: normal-conducting electromagnet, magnetic flux density: 0.3 T, current is flowed by pressing a plate terminal to a cast slab Method D: superconducting electromagnet, magnetic flux density: 1.1 T Method E: superconducting electromagnet, magnetic flux density: 1.1 T, current is flowed by pressing a plate terminal to a cast slab The cast slab obtained by each of the above methods is cut into a slice at a pitch of 10 mm in thickness direction, from which is measured the number of inclusions in the slab by an X-ray permeation process. The maximum value measured is shown in FIG. 32 by an index on the basis that the value of the method A is 1. From this figure, it is understood that the internal quality of the cast slab in the methods D, E is considerably improved as compared with those in the methods A–C.

Furthermore, after the cast slab obtained by each of the methods is subjected to hot rolling and cold rolling, magnetic flaw detecting test (MT test) is made, from which it has been confirmed that there is a tendency similar to FIG. 32.

EXAMPLE 4

A continuous casting of 7200 charges (260 tons per one charge) is carried out by casting molten steel having a chemical composition of C: 10–15 ppm, Si: 0.008–0.005 wt %, Mn: 0.15–0.2 wt %, P: 0.02–0.025 wt %, S: 0.008–0.012 wt %, Al: 0.025–0.035 wt % and T: 25–31 ppm in a continuous casting machine provided with a mold having a construction shown in FIG. 15, FIG. 17, FIG. 18 and FIG. 19, in which a distance between long-side walls (a thickness of a cast slab) is 220 mm, a distance between short-side walls (a width of the cast slab) is 1600 mm and a superconducting electromagnet for the generation of static field having a length of 200 mm and a width of 2000 mm (Nb—Ti wire) is arranged on the rear of the long-side wall, under the following conditions, and the nozzle clogging of immersion nozzle in the casting, the state of generating breakout and internal and surface qualities (coil defect ratio) of the resulting slab are examined. The results are shown in Table 2 with results of a comparative example conducting the continuous casting under the same conditions as mentioned above except that stating field is not applied.

Conditions

Magnetic flux density: 1.0 T (equal static field is applied in both meniscus portion and lower portion of molten steel)

Throughput of molten steel: 8 ton/min

Value of current applied at electrode: 800 A a. Two-hole type immersion nozzle nozzle size: 80 mm in inner diameter
size of discharge port in immersion nozzle: square having a side of 80 mm
discharge angle of immersion nozzle: 20° downward
position of discharge port in immersion nozzle: 230 mm from meniscus up to an upper end of discharge port of nozzle
position of meniscus: position of +20 mm from upper end of coil applying static field b. Single-hole type immersion nozzle
nozzle size: 80 mm in inner diameter
position of discharge port in immersion nozzle: 230 mm from meniscus up to a top end of nozzle
position of meniscus: position of +20 mm from upper end of coil applying static field

TABLE 2

| Application type of magnetic field | Items: Index of nozzle clogging* | Index of molten steel temperature in mold (°C.)*1 | Occurrence ratio of coil defect (%)*2 | Occurrence ratio of breakout (%)*3 |
|---|---|---|---|---|
| Acceptable Example FIG. 15 | 0.03 | 2 ± 1 | 0.01 | ≦0.03 |
| Acceptable Example FIG. 17 | 0.03 | 2 ± 1 | 0.01 | ≦0.03 |
| Acceptable Example FIG. 18 | 0.03 | 2 ± 1 | 0.007 | ≦0.03 |
| Acceptable Example FIG. 19 | 0.03 | 2 ± 1 | 0.01 | ≦0.03 |
| Comparative Example | 0.42 | 10 ± 1 | 0.16 | 0.3 |

*6 continuous casting
Index of nozzle clogging: $(S_b-S_a)/S_b$
$S_b$: Area of discharge port in nozzle before casting
$S_a$: Area of discharge port in nozzle after casting
*1Index of molten steel temperature in mold: $T_t-T_m$ (°C.)
$T_t$: tundish temperature
$T_m$: temperature in mold
*2Occurrence ratio of coil defect: $D_p/N \times 100$
(cold rolled coil rolled to sheet is called as coil simply)
N: total coil
$D_p$: defect occurrence ratio
*3Occurrence ratio of breakout: $N_b/N \times 100(\%)$
N: total number of casting charges
$D_p$: casting charge generating breakout As seen from Table 2, in the continuous casting according to the invention, the entrapment of mold powder and the variation of molten steel surface can be reduced even in the casting having a throughput of molten steel of 8 ton/min, so that good internal and surface qualities can be ensured. It has been confirmed that carefree cast slab can stably be produced in the high-speed continuous casting.

EXAMPLE 5

A continuous casting is carried out by methods A–C under the following conditions.

Conditions

Kind of steel to be cast:
Extremely-low carbon aluminum killed steel (C: 20–25 ppm, P: 0.02–0.03 wt %, S: 0.008–0.010 wt %, Al: 0.025–0.035 wt %, T.O: 30–40 ppm)

Size of mold:
width of 1500 mm and thickness of 200 mm corresponding to size of cast slab Weight of mold (excluding an electromagnet):
11 t per one mold Casting rate: 3.6 m/min Throughput: 7.56 t/min/strand Stroke of mold: 9 mm Oscillation number of mold: 230 cpm Arrangement of electromagnet:
full width of long-side wall of mold, 2 up-and-down stages (FIG. 27, FIG. 29)

Magnetic flux density:
0.4 T (limit value) to meniscus portion and lower portion of molten steel in normal-conducting electromagnet, 0.7 T to both the meniscus portion and the lower portion of molten steel jetted in superconducting electromagnet Method A: normal-conducting electromagnet having an iron core, weight of the magnets (total weight) is 19 t on both long-side walls of the mold Method B: normal-conducting electromagnet having no iron core, weight of the magnets (total weight) is 3 t on both long-side walls of the mold Method C: superconducting electromagnet, air-core, weight of the magnets (total weight) is 2 t on both long-side walls of the mold In these methods A–C, total weight of mold and electromagnet, upper limit of vibration frequency, upper limit of negative strip ratio and maximum magnetic flux density in the mold are measured. The results are shown in Table 3.

TABLE 3

| Kind | Total weight of mold and electromagnet (t) | Maximum value of oscillation number for mold (cpm) | Maximum value of negative strip ratio (%) | Maximum value of magnetic flux density (T) | Remarks |
|---|---|---|---|---|---|
| Method A | 30 | 150 (2.5 Hz) | −25 | 0.30 | comparative Example |
| Method B | 14 | 220 (3.7 Hz) | 10 | 0.14 | Acceptable Example |
| Method C | 13 | 230 (3.8 Hz) | 15 | 1.1 | Acceptable Example |

Figure 33:
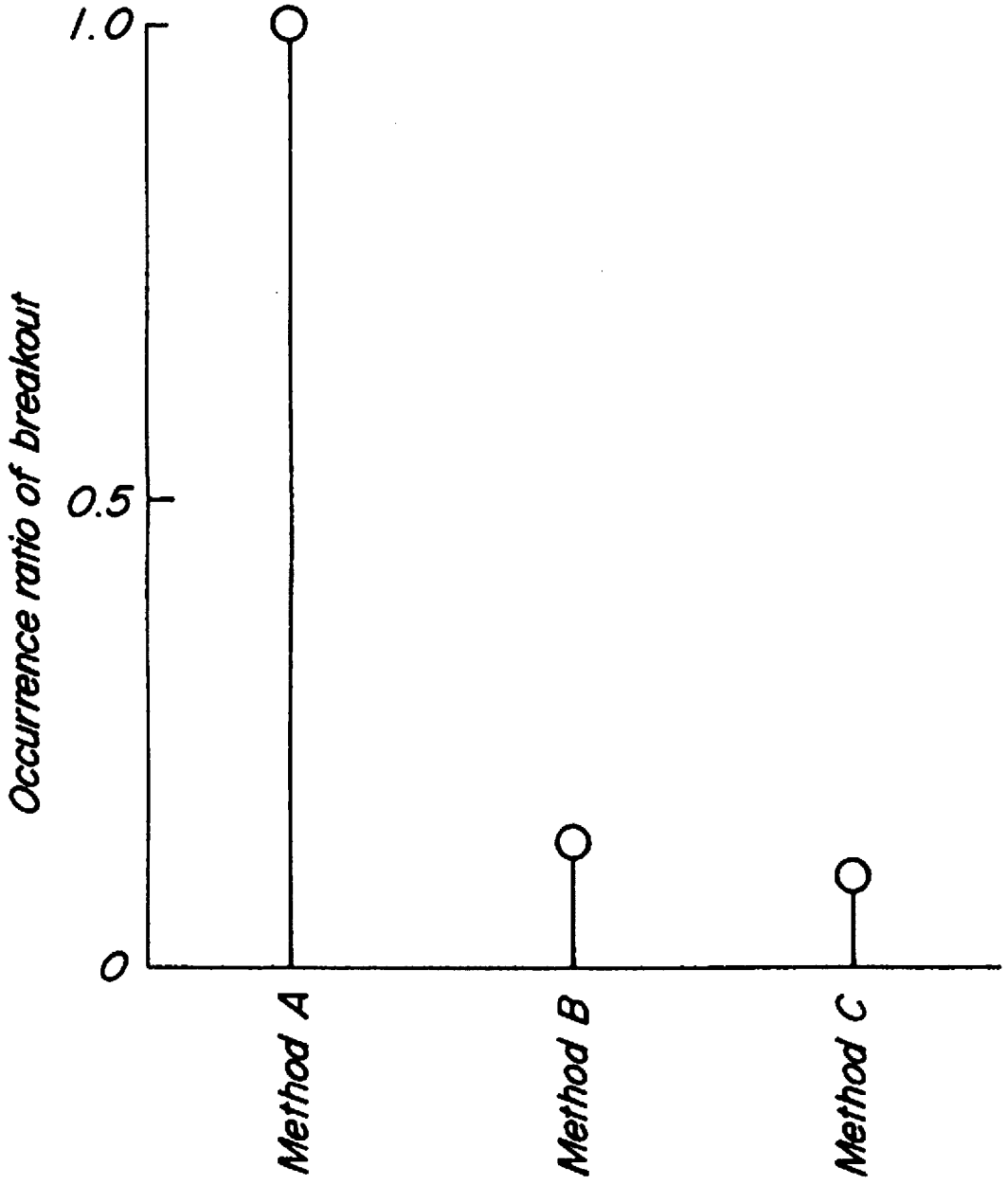
FIG. 33 is a graph showing results of measurements of occurrence ratio of breakout.
Figure 34:
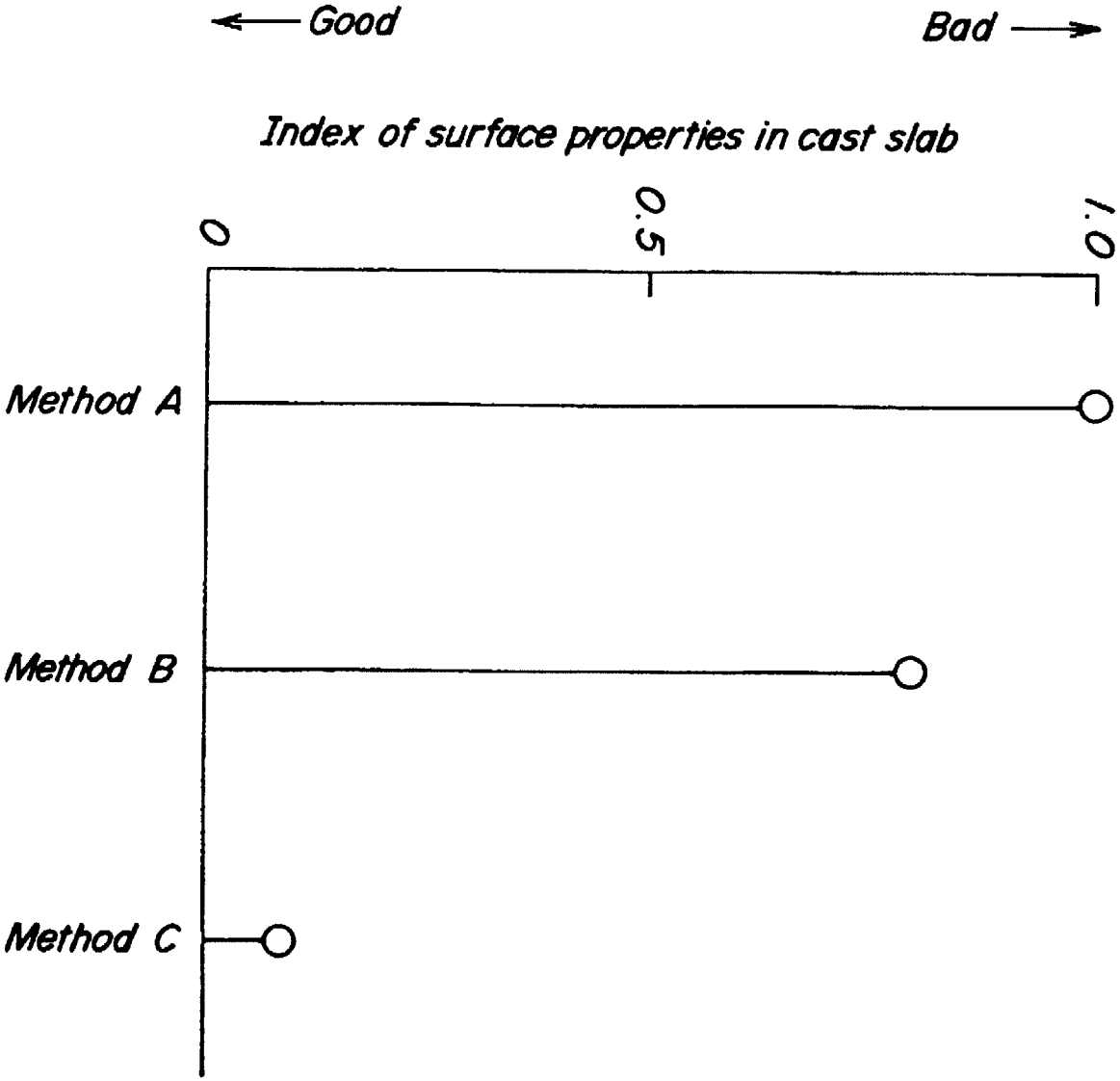
FIG. 34 is a graph showing results of measurements of surface properties of a cast slab.

The occurrence ratio of breakout in each of these methods is shown in FIG. 33, and the results examined on the surface properties of the cast slab are shown in FIG. 34, respectively. Moreover, the occurrence ratio of breakout (ratio of casting heat) is represented by a relative evaluation as a standard of 0.9% in the method A, while the surface properties of the cast slab are represented by a relative evaluation on the basis that the value of the method A is standard when the number of inclusions and bubbles adhered to the surface of the cast slab after the hot scarfing of the slab is measured to determine the adhesion number per unit area. From Table 2 and FIG. 33 and FIG. 34, it is understood that in the methods B, C according to the invention, the weight of the electromagnet can be reduced and the oscillation of the mold can be made higher, whereby the negative strip ratio can be set to a higher cycle and hence the occurrence ratio of breakout is considerably decreased as compared with that in the method A.

As to the surface properties of the cast slab, the effect of reducing the oscillation mark depth by the high cycle of vibration frequency in the mold is offset by the lowering of the magnetic flux density in the method B, but the surface properties are improved as compared with the method A. In case of the method C, the magnetic flux density is 1.1 T and is very higher than 0.3 T in case of the method A, so that the surface properties of the slab is considerably improved with the high cycle in the vibration frequency of the mold.

After the resulting cast slab is subjected to hot rolling and cold rolling, the surface defect is examined to obtain a result similar to FIG. 34.

INDUSTRIAL APPLICABILITY

According to the invention, the following effects can be expected.

1. The lowering of temperature in the molten steel surface inside the mold is small, so that the occurrence of nozzle clogging is very less. Furthermore, entrapment of mold powder, entrapment of inclusions, surface defects due to oscillation and the like are mitigated and further remelting of steel can be avoided, so that cast slabs having good surface and internal qualities can stably be produced.

2. An air-core superconducting electromagnet is used as means for the application of a static field and is supported so as to change a distance between magnetic poles of the superconducting coil independently of a support system for a mold for continuous casting, so that the variation in a molten steel surface in a mold can be minimized. Furthermore, extra stress is not applied to a coiling plate of the mold, so that breakout due to the leakage of molten steel based on the deformation of the cooling plate can be avoided. And also, the adjustment of magnetic flux can simply be made. Moreover, the braking ability can be enhanced without increasing the size of the apparatus itself, so that the cast slab having a high quality can be produced and it can easily be coped with the high-speed continuous casting having a throughput of molten steel of more than 6 ton/min.

3. An electrical terminal leading induction current is arranged on each short-side wall of the mold and one of the terminals on the short-side walls of the mold is connected to the other terminal through a conductor means to form a closed circuit of induction current, so that the flow of molten steel can effectively be controlled without the occurrence of a force obstructing the braking of molten steel flow.

4. The flow rate of molten steel jetted can more be decreased by flowing current in the mold for continuous casting at a state of applying static field, so that even if the high-throughput, high-speed casting is conducted, mold powder is not entrapped and the inclusions are not deeply entrapped, while the defects due to oscillation and the like are mitigated and further remelting of solidification shell can be avoided and hence cast slabs having good surface and internal qualities can stably be produced.

5. Since the air-core superconducting electromagnet having no iron core is used as means for applying static field to the mold for continuous casting, the oscillation number of the mold can be increased, whereby the oscillation mark depth can be reduced and it is possible to maintain the negative strip ratio within a good rage even in the high-throughput, high-speed continuous casting and also the surface properties of the slab can be improved with the maintenance of the casting stability.

We claim:

1. A method of continuously casting steel by controlling a jet of molten steel fed through an immersion nozzle into a mold for continuous casting while applying a static field between opposed side walls of the mold for the continuous casting, characterized in that molten steel is fed into the mold for the continuous casting at a throughput of not less than 6 t/min, and that an air-core superconducting electromagnet is used to simultaneously apply a static field having a magnetic flux density of greater than 0.5 T to a meniscus portion in the mold for the continuous casting and a static field having a magnetic flux density of greater than 0.5 T to a lower portion of molten steel jetted out from a discharge port of the immersion nozzle.

2. A continuous casting method according to claim 1, wherein the static field is applied to a full region in width-wise direction of the mold including the meniscus portion and the lower portion of molten steel jetted.

3. A continuous casting method according to claim 1, wherein the mold for the continuous casting is oscillated during the feeding of molten steel so as to satisfy the following equation:

$$S \cdot F \geqq 450$$

where

S: up and down strokes (mm) of the mold for the continuous casting

F: oscillation number (cpm)) in the feeding of Z molten steel through the immersion nozzle.

4. A continuous casting method according to claim 1, wherein a gas is blown into the immersion nozzle so as to satisfy the following condition:

$$0.5Q \leqq f \leqq 20+3Q$$

where f: gas blowing amount (Nl/min)

Q: throughput of molten steel (t/min).

5. A continuous casting method according to claim 1, wherein the immersion nozzle is a single-hole type straight nozzle.

6. A continuous casting method according to claim 1, wherein the air-core superconducting electromagnet applying the static field is arranged on each rear of opposed side walls in the mold for the continuous casting independently of a support system for the mold, and a distance between magnetic poles of the superconducting electromagnet is changed so as to approach with each other or separate away from each other in accordance with casting conditions to adjust a magnetic flux density of the static field.

7. A continuous casting method according to claim 1, wherein current is applied to the mold for the continuous casting.

8. A continuous casting method according to claim 1, wherein an induction current generated by the application of the static field is taken out from a short-side wall of the mold for the continuous casting and supplied to the other short-side wall thereof to circulate the induction current.

* * * * *

UNITED STATES PATENT AND TRADEMARK OFFICE

CERTIFICATE OF CORRECTION

PATENT NO. : 5,632,324
DATED : May 27, 1997
INVENTOR(S) : Seiko Nara et al

It is certified that error appears in the above-indentified patent and that said Letters Patent is hereby corrected as shown below:

In Column 1, line 37, please change "inclusion" to --inclusions--; and line 66, please change "remaining" to --remain--.

In Column 2, line 39, please change "continuously" to --continuous--.

In Column 6, line 1, please change "Ai:" to --Al:--.

In Column 7, line 34, please delete "downstream of";

line 35, please change "downstreamed" to --downstream--; and line 45, please change "concerned" to --a concern--.

In Column 8, line 6, please change "superheat of" to --superheated--; and line 19, please change "aiming at" to --of--.

UNITED STATES PATENT AND TRADEMARK OFFICE

CERTIFICATE OF CORRECTION

PATENT NO. : 5,632,324

DATED : May 27, 1997

INVENTOR(S) : Seiko Nara et al

It is certified that error appears in the above-indentified patent and that said Letters Patent is hereby corrected as shown below:

In Column 9, line 62, please change "recover" to --recovery--.

In Column 11, line 17, please change "slows" to --flows--; and line 35, please delete "wasteful".

In Column 12, line 8, please change "slows" to --flows--;

line 26, please change "that" to --where a--; and line 56, please delete "range of", first and second occurrences.

Signed and Sealed this

Twenty-sixth Day of August, 1997

*Attest:*

Bruce Lehman

BRUCE LEHMAN

*Attesting Officer*

*Commissioner of Patents and Trademarks*